US010100615B2

(12) United States Patent
Randle

(10) Patent No.: US 10,100,615 B2
(45) Date of Patent: Oct. 16, 2018

(54) SYSTEMS AND METHODS FOR MANAGING DEBRIS IN A WELL

(71) Applicant: SPOKED SOLUTIONS LLC, Houston, TX (US)

(72) Inventor: Bryce Elliott Randle, Highlands Ranch, CO (US)

(73) Assignee: Spoked Solutions LLC, Houston, TX (US)

( * ) Notice: Subject to any disclaimer, the term of this patent is extended or adjusted under 35 U.S.C. 154(b) by 0 days.

(21) Appl. No.: 15/714,207

(22) Filed: Sep. 25, 2017

(65) Prior Publication Data

US 2018/0016872 A1 Jan. 18, 2018

Related U.S. Application Data

(63) Continuation-in-part of application No. 14/926,326, filed on Oct. 29, 2015.

(Continued)

(51) Int. Cl.

| | |
|---|---|
| ***E21B 37/08*** | (2006.01) |
| ***E21B 27/00*** | (2006.01) |
| ***E21B 21/00*** | (2006.01) |
| ***E21B 34/08*** | (2006.01) |
| ***E21B 21/12*** | (2006.01) |
| ***E21B 34/06*** | (2006.01) |
| ***E21B 37/00*** | (2006.01) |
| ***E21B 43/04*** | (2006.01) |
| ***E21B 43/08*** | (2006.01) |
| ***E21B 17/00*** | (2006.01) |
| ***E21B 21/01*** | (2006.01) |
| *E21B 34/00* | (2006.01) |

(Continued)

(52) U.S. Cl.

CPC ..... *E21B 37/08* (2013.01); *E21B 17/006* (2013.01); *E21B 21/001* (2013.01); *E21B 21/01* (2013.01); *E21B 21/12* (2013.01); *E21B 27/005* (2013.01); *E21B 34/06* (2013.01); *E21B 34/08* (2013.01); *E21B 37/00* (2013.01); *E21B 43/04* (2013.01); *E21B 43/045* (2013.01); *E21B 43/08* (2013.01); *E21B 43/26* (2013.01); *E21B 43/267* (2013.01); *E21B 2034/002* (2013.01)

(58) Field of Classification Search

CPC ..... E21B 43/02; E21B 43/025
USPC ..... 166/205, 235
See application file for complete search history.

(56) References Cited

U.S. PATENT DOCUMENTS 4,162,705 A 7/1979 Daigle
5,330,003 A 7/1994 Bullick (Continued)

OTHER PUBLICATIONS

"Downhole Tool Systems," Halliburton, 2014, pp. 2-1 / 2-38.

(Continued)

*Primary Examiner* — Sean D Andrish
(74) *Attorney, Agent, or Firm* — Sheridan Ross P.C.

(57) ABSTRACT

Various systems, methods, and devices are disclosed for handling contaminants in a wellbore or riser. A washpipe debris trap (WPDT) traps contaminants traveling up a wellbore from a downhole location, and the WPDT may serve as an indicator for a breached screen in a downhole location. A marine riser reversing tool (MRRT) may reverse the flow of fluid between a workstring conduit and an annulus between the workstring and the wellbore such that fluid rises to the wellhead with greater velocity. A bi-directional chamber trap (BDCT) may be utilized in a wellbore operation to remove contaminants from a fluid.

20 Claims, 17 Drawing Sheets

Related U.S. Application Data

(60) Provisional application No. 62/073,572, filed on Oct. 31, 2014, provisional application No. 62/203,476, filed on Aug. 11, 2015, provisional application No. 62/398,876, filed on Sep. 23, 2016.

(51) Int. Cl.
*E21B 43/26* (2006.01)
*E21B 43/267* (2006.01)

(56) References Cited

U.S. PATENT DOCUMENTS

| | | | |
|---|---|---|---|
| 6,250,387 | B1 | 6/2001 | Carmichael et al. |
| 6,641,730 | B2 | 11/2003 | Poole |
| 6,702,020 | B2 | 3/2004 | Zachman et al. |
| 7,128,151 | B2 | 10/2006 | Corbett |
| 2008/0011480 | A1 | 1/2008 | Plucheck et al. |
| 2010/0170673 | A1 | 7/2010 | Krueger et al. |
| 2010/0258298 | A1 | 10/2010 | Lynde et al. |
| 2010/0294507 | A1 | 11/2010 | Tanton |
| 2011/0214872 | A1 | 9/2011 | Crawford et al. |
| 2012/0118571 | A1 | 5/2012 | Zhou |

OTHER PUBLICATIONS

Al-Khalifah, "Sand Production in Oil Wells," Dec. 16, 2011, retrieved from http://www.slideshare.net/the_duke7/sand-problem-in-oil-wells, retrieved on Mar. 1, 2016, 15 pages.
Carlson et al., "Sand Control: Why and How?," Oilfield Review, 1992, pp. 41-53.
International Search Report and Written Opinion for International (PCT) Patent Application No. PCT/US15/58086, dated Jan. 27, 2016, 9 pages.
International Preliminary Report on Patentability for International (PCT) Patent Application No. PCT/US2015/058086, dated May 11, 2017 8 pages.
Official Action for U.S. Appl. No. 14/926,326, dated Oct. 26, 2017 17 pages.
Official Action for U.S. Appl. No. 14/926,326, dated Mar. 9, 2018 14 pages.
Official Action for U.S. Appl. No. 14/926,326, dated Apr. 26, 2018 8 pages.
Official Action for U.S. Appl. No. 15/119,427, dated Apr. 20, 2018 19 pages.

SYSTEMS AND METHODS FOR MANAGING DEBRIS IN A WELL

CROSS REFERENCE TO RELATED APPLICATIONS

This application claims the benefit of U.S. Provisional Patent Application Ser. No. 62/398,876, filed Sep. 23, 2016, and this application is a continuation-in-part of U.S. patent application Ser. No. 14/926,326, filed Oct. 29, 2015, which claims the benefit of U.S. Provisional Patent Application Ser. No. 62/073,572, filed Oct. 31, 2014, and U.S. Provisional Patent Application Ser. No. 62/203,476, filed Aug. 11, 2015, all of which are incorporated by reference in their entirety.

FIELD OF THE INVENTION

The present invention relates to several novel tools useful in the field of drilled wells, particularly in the areas of cleaning operations, sand control operations and debris and trash management measures.

BACKGROUND

Various types of debris or other undesirable materials are produced during the drilling, completion, production, intervention, and workovers of drilled wells. These materials, if not adequately managed, can cause various issues, spanning from decreasing the efficiency of well operations to complete loss of a well.

When debris is pumped or introduced to a drilling rig circulation system, such debris or trash has the potential to become lodged in downhole equipment utilized during drilling, intervention, workover, or completion causing sub-satisfactory performance or failure. In addition, downhole production equipment may also be impaired or restricted to future access.

Examples of debris or trash include, but are not limited to tools, paint chips, personal safety equipment, pipe dope, metal shavings, rust, fibers, precipitated fluid chemicals, mud, or formations. Any of the previously mentioned examples of debris have the potential to reduce performance or failure in surface or downhole equipment.

Traditional circulation filtration systems filter at low pressure, are comprised of settling tanks and pumps, or utilized a filtration medium such as diatomaceous earth or absolute filtration layers to remove undesirables from fluid systems. Most of these circulation systems focus on the cleanliness of fluid as it exits a well, only permits flow in one direction, requires manning by third party personnel, and negates contamination points between its discharge and well entry points.

Additionally, drilled wells that penetrate soft rock formations, typically located in offshore environments, often produce formation sand resulting in significant damage to wellbore equipment, surface facilities, and infrastructure utilized to transport hydrocarbon to commercial terminals. Well known industry sand control methods such as gravel packing or hydraulic fracturing are utilized to immobilize the formation sand and increase the productivity of wells. The methods utilize a combination of sand control screens and sand control tools to place uniquely sized proppant based on formation particle sized distribution to act as a filter and achieve the immobilization.

The operation of placing the uniquely sized proppant successfully relies on a sand control service tool being in the correct position, the integrity of a crossover port surviving the operation, and the integrity of sand control screens surviving deployment and the proppant placement operation.

Although methods to correctly identify tool placement and maintaining the desired placement throughout pumping operations has been battled and advances have been made on shelf wells, the ability to maintain and verify tool position becomes increasingly more difficult due to the existence of smaller companies utilizing older technology and new exploration reaching increasing farther depths. The consequence of a tool being in the incorrect position, or being pumped out of position, is proppant reaching the annular space above the sand control packer between the casing and the workstring/service tool assembly.

The failure of crossover port integrity is often attributed to erosion created by the properties and volumes of proppant placed during an operation. Reaching into the hundreds of thousands of pounds of proppant and sometimes into the millions, this failure exposes the gundrill ports of the crossover tool and subsequently the washpipe or annular space above the sand control packer between the casing and the workstring/service tool assembly to proppant.

Typically resulting in sticking the sand control service tool, the above failures are potentially recovered from through various recovery operations but may result in the loss of the target zone. An integrity breach of sand control screens also results in proppant reaching the annular space above the sand control packer between the casing and the workstring/service tool assembly, however, it bears the added consequence of proppant sticking to the inner string conduit (often referred to as washpipe) across the sand control interval, complete loss of sand control integrity, increased sand production and costs associated with handling/disposal at the surface, and potential loss of the well. It is this mode of failure that has the potential to go unrealized until a well is brought into production.

Aside from eliminating the potential for sticking the sand control service tool, it would be significantly desirable to know if sand control screen integrity exists prior to running the production tubing or moving off of location with the rig.

In addition to debris in the form of sand and misplaced proppant, drilling fluid and other materials pumped into the well may pose a threat to operations under certain circumstances. Riser pipes are used to connect a well at the seabed to a rig. In some cases, such as with a compliant tower, the riser is utilized to connect the subsea wellhead or subsea tree to a platform. In deepwater, the cold seawater temperature can cause congealing of the drilling fluid, such as mud, or precipitation of brine within the riser pipe. The larger internal diameter of riser in relation to its pressure ratings and optimum pump rate abilities of the rig typically lead to an insufficient ability to achieve the turbulent flow and annular velocities required to clean, displace, and carry all of the existing debris, congealed fluid, etc. from the pipe. Consequently, it can take several staged treatments and multiple days, depending on seabed depth, to successfully clean and displace riser to a suitable fluid for operations to proceed.

SUMMARY OF THE INVENTION

The present invention relates generally to three tools utilized to manage debris and other undesirable material in a well system. Such management can be carried out through the filtering of fluid being pumped into a well, ensuring integrity of sand control systems, and ensuring riser pipe and other surfaces are clean of debris and other material.

One aspect of the present invention relates generally to an apparatus and method for filtering solid debris from surface and wellbore fluid systems. There is a need for a low level filtration system that resides within a rig's circulation infrastructure that is capable of removing debris and trash encountered between traditional systems and wellbore entry points. In particular, but not exclusively, the invention relates to a tool for filtering drilling stand pipe surface lines, surface storage systems, drilling rig circulation systems, and wellbore systems that fluid passes through during drilling, interventions, and completion/workovers of offshore and land wells.

An objective of the invention is to provide an apparatus to facilitate the passive removal of large and small debris and trash such as tools, paint chips, personal safety equipment, pipe dope, metal shavings, rust, fibers, precipitated fluid chemicals, mud, or formations from a rig's circulation system. In addition, the apparatus will be capable of receiving module adaptors that provide increased levels of filtration, fluid shearing abilities, pressure monitoring, and fluid properties.

Another objective of the invention is to permit the change out of filters or modules without the need to execute additional surface line pressure tests to requalify the system for operations with working pressure ratings equal to the system it has been integrated with.

A further objective is to permit filtering of the rig's circulation system for fluids both entering and exiting the well without the need for reconfiguration or a dedicated operator. The horizontal parallel design with offset entry/exit points, baffling, and debris fluidization system allow the system to operate continuously while simultaneously removing filter mediums and modules or transferring captured debris.

An apparatus of this nature may provide the following benefits: filtering mediums with direction preferred fluid check devices to permit filtering and flow in multiple directions; a means to divert fluid flow to permit continuous operation while inspecting or reconfiguring modules; an internal system for fluidizing fine debris material and transferring it to a rig disposal system; a pressure rating equal to or in excess of the rigs circulating system pressure rating; and a pressure indicator to alarm of large debris capturing.

Another aspect of the present invention relates to an apparatus and method for cleaning the internal surface of pipes. In particular, but not exclusively, the invention relates to a tool for, and a method of, cleaning the internal surface of riser pipes used for drilling, interventions, completion, and workovers of offshore wells. The apparatus warrants the forward circulation of the marine riser, but permits pumping down the workstring. Unlike traditional tools utilized for wellbore and riser cleaning, the apparatus diverts the flow from the workstring, allowing treatment fluids to be placed in direct contact with the riser and isolates the treatment with a sealing element. Returns are received in the annulus above the sealing element and are then handled on surface. The flow path of the apparatus, thus addresses common concerns with cleaning risers that include but are not limited to lift velocity, chemical volume, riser pressure ratings, slip-joint pack-off ratings, surface filtration capacity, and rig time.

An objective of the invention is to provide an apparatus to facilitate the removal of congealed drilling fluid such as mud or brine from within a marine riser internal diameter and the associated equipment in line with the riser such as blow out preventers.

Another objective of the invention is to aid in lift velocity by utilizing flow paths other than the traditional flow paths typically used to clean pipe body internal diameters, completely eliminating the requirement of high annular velocities.

A further objective is to minimize applied pressure to the internal diameter of the marine riser which traditionally is a limiting factor in achieving optimal cleaning efficiency. This will ultimately reduce risks associated with mechanical failure of associated equipment and increase efficiency of surface operations such as filtering.

An apparatus of this nature may provide the following benefits: contain a sealing element to create a workstring/marine riser annulus; be capable of seamlessly integrating into currently existing wellbore cleanout tool system technology; utilize the smaller workstring internal diameter as the lifting conduit, thus increasing lift velocity; be capable of proper operating pressures to achieve proper clean-up irrespective of seabed depth; aid in debris removal by allowing blow out preventers to be functioned while cleaning; clean above tree plugs and run in impression block before downhole before running subsea test trees; and aid in greener open water riser clean-ups.

Another aspect of the present invention relates to sand control failure mitigation and identification for sand control operations conducted in wells requiring inner string conduits and, in particular, a method to identify sand control screen failure or sand control tool failure when service tools and inner string conduits are retrieved at surface.

An objective of the invention is to provide an apparatus to eliminate sand from reaching the annular space above the sand control packer between casing and the workstring/service tool assembly.

Another objective of the invention is to trap proppant in the washpipe and to prevent it from reaching the annular space above the sand control packer between the casing and workstring/service tool assembly when a breach occurs via the sand control screens or crossover port body.

A further object is to provide an indicator for the operator or sand control company to identify and confirm an integrity breach in the sand control hardware prior to demobilizing costly equipment from location or bringing the well onto production.

A further object is to provide an apparatus that is cost efficient, adjustable to the selected sand control design, and integrates seamlessly. One advantage of the invention lies in a simple, low cost solution to the potential detriment of a reservoir, wellbore, platform processing equipment, and/or pipelines.

A further object is to provide other applications of the present invention, including the Marine Riser Reversing Tool (MRRT). For example, embodiments of the present invention may be capable of through-tubing operations on multiple workstring sizes inclusive of coil tubing. In addition, embodiments of the present invention may be capable of coil tubing operations for fluid manipulation. Lastly, embodiments of the present invention may be capable of wire line or electric line deployment and placement for permanent and semi-permanent installation.

One particular embodiment of the present invention is a system for cleaning an annulus in a wellbore or riser, comprising a workstring comprising a plurality of drill pipe positioned in a wellbore or riser, the plurality of drill pipe form a conduit for a fluid to flow through the workstring, and an outer diameter of the plurality of drill pipe and an inner diameter of the wellbore or riser form an annulus for the fluid to flow through; a reversing tool positioned in the workstring, the reversing tool having a body with a bottom end and a top end, a first channel in fluid communication with the conduit at the top end and the annulus at the bottom end, and a second channel in fluid communication with the annulus at the top end and the conduit at the bottom end; and a debris trap positioned in the workstring, the debris trap having an upper assembly, a lower assembly, and a chamber formed between the upper assembly and the lower assembly, the upper assembly comprising an upper screen, and the lower assembly comprising a lower screen and a check valve.

Various embodiments of the system for cleaning an annulus in a wellbore or riser may further comprise a blow out preventer positioned in the wellbore or riser, the reversing tool and the debris trap are positioned above the blow out preventer in the wellbore or riser. Embodiments may further comprise a control screen positioned between the conduit of the plurality of drill pipe and the annulus between the plurality of drill pipe and the wellbore or riser, the control screen is configured to filter contaminants from the fluid flowing between the annulus and the conduit. In various embodiments, the control screen, the upper screen, and the lower screen have a substantially similar gauge size. Embodiments may further comprise a washpipe positioned in the workstring, the washpipe forms a lower terminus of the conduit, and the debris trap is positioned in the washpipe. In some embodiments, a cross sectional area of the annulus formed between the plurality of drill pipe and the wellbore or riser may be larger than a cross sectional area of the conduit of the plurality of drill pipe. In various embodiments, the reversing tool further may comprise a seal, and an outer diameter of the seal is larger than an outer diameter of the body of the reversing tool.

In some embodiments, the first channel extends between a first opening at the top end and a second opening at the bottom end and the second channel extends between a first opening at the bottom end and a second opening at the top end, cross sectional areas of the second openings of the first and second channels are larger than cross sectional areas of the first openings of the first and second channels. In some embodiments, the second openings of the first and second channels comprise at least one of a chamfer and a round. Embodiments may further comprise a second seal positioned proximate to the first seal, each seal comprises a cup retainer and a cup seal, and a spacer sleeve is positioned between the seals. In various embodiments, the first channel and the second channel are substantially straight.

In some embodiments, the lower screen of the lower assembly is a thru-tubing screen, and the upper screen of the upper assembly is a thru-tubing screen, and the upper assembly comprises a bull plug. In various embodiments, the check valve of the lower assembly is a ball check valve that is open when the fluid flows in a forward direction, allowing the fluid and debris to enter the chamber, and closed when the fluid flows in a reverse direction, allowing only the fluid and debris smaller than a gauge of the thru-tubing screen of the lower assembly to leave the chamber. In some embodiments, the debris trap is positioned in the workstring below the reversing tool, the fluid flows through the lower assembly, the chamber, and then the upper assembly of the debris trap. In various embodiments, the debris trap is positioned in the workstring above the reversing tool, the fluid flows through the lower assembly, the chamber, and then the upper assembly of the debris trap.

In some embodiments, the fluid flows through the lower assembly of the debris trap, the chamber of the debris trap, and the upper assembly of the debris trap, the fluid has a first density; and the lower screen of the lower assembly is a thru-tubing screen, and the upper screen of the upper assembly is a thru-tubing screen, and the upper assembly comprises a ball check valve having a ball with a second density, the second density is less than the first density. In some embodiments, the check valve of the lower assembly is a ball check valve that is closed when the fluid flows in a forward direction, allowing allow only the fluid and debris smaller than a gauge of the thru-tubing screen of the lower assembly to leave the chamber, and open when the fluid flows in a reverse direction, allowing the fluid and debris to enter the chamber; and the ball check valve of the upper assembly is open when the fluid flows in a forward direction, allowing the fluid and debris to enter the chamber, and closed when the fluid flows in a reverse direction, allowing allow only the fluid and debris smaller than a gauge of the thru-tubing screen of the upper assembly to leave the chamber. In various embodiments, the debris trap is positioned in the workstring below the reversing tool, the fluid flows through the lower assembly, the chamber, and then the upper assembly of the debris trap. In some embodiments, the debris trap is positioned in the workstring above the reversing tool, the fluid flows through the lower assembly, the chamber, and then the upper assembly of the debris trap.

Another particular embodiment is a device for reversing fluid flow in a drillstring, comprising a body extending between a top end and a bottom end, the body having a longitudinal axis, the body having a conduit cross sectional area disposed about the longitudinal axis and extending between the top end and the bottom end, and the body having an annular cross sectional area disposed about the conduit cross sectional area and extending between the top end and the bottom end; a first channel in the body, the first channel extending between the conduit cross sectional area at the top end and the annular cross sectional area at the bottom end; a second channel in the body, the second channel extending between the annular cross sectional area at the top end and the conduit cross sectional area at the bottom end; and a seal positioned on the body, an outer diameter of the seal is larger than an outer diameter of the body.

In some embodiments, the first channel extends between a first opening at the top end and a second opening at the bottom end, and the second channel extends between a first opening at the bottom end and a second opening at the top end, cross sectional areas of the second openings of the first and second channels are larger than cross sectional areas of the first openings of the first and second channels. In various embodiments, the second openings of the first and second channels comprise at least one of a chamfer and a round. Embodiments may further comprise a second seal positioned proximate to the first seal, each seal comprises a cup retainer and a cup seal, and a spacer sleeve is positioned between the seals. In various embodiments, the first channel and the second channel are substantially straight. In some embodiments, the annular cross sectional area is larger than the conduit cross sectional area.

A further particular embodiment of the present invention is a device for trapping debris, comprising a lower assembly having a lower screen and a check valve, the lower screen is a thru-tubing screen; an upper assembly having an upper screen and a bull plug, the upper screen is a thru-tubing screen; and a chamber formed between the lower assembly and the upper assembly.

In some embodiments, the check valve is a ball check valve that is configured to open when a fluid flows in a forward direction, allowing the fluid and debris to enter the chamber, and is configured to close when the fluid flows in a reverse direction, allowing only the fluid and debris smaller than a gauge of the thru-tubing screen of the lower assembly to leave the chamber. In various embodiments, the lower screen and the upper screen have a substantially similar gauge.

Another particular embodiment of the present invention is a system for trapping debris, comprising a lower assembly having a lower screen and a check valve, the lower screen is a thru-tubing screen; an upper assembly having an upper screen and a check valve, the upper screen is a thru-tubing screen, and the check valve of the upper assembly is a ball check valve having a ball with a first density that is buoyant when submerged in fluid having a second density, wherein the second density is larger than the first density; a chamber formed between the lower assembly and the upper assembly.

In some embodiments, the check valve of the lower assembly is a ball check valve that is closed when the fluid flows in a forward direction, allowing the fluid and debris smaller than a gauge of the thru-tubing screen of the lower assembly to leave the chamber, and open when the fluid flows in a reverse direction, allowing the fluid and debris to enter the chamber. In various embodiments, the ball check valve of the upper assembly is open when the fluid flows in a forward direction, allowing the fluid and debris to enter the chamber, and closed when the fluid flows in a reverse direction, allowing only the fluid and debris smaller than a gauge of the thru-tubing screen of the upper assembly to leave the chamber. In some embodiments, the lower screen and the upper screen have a substantially similar gauge.

I. BRIEF DESCRIPTION OF THE DRAWINGS

II. DETAILED DESCRIPTION

Figure 1A:
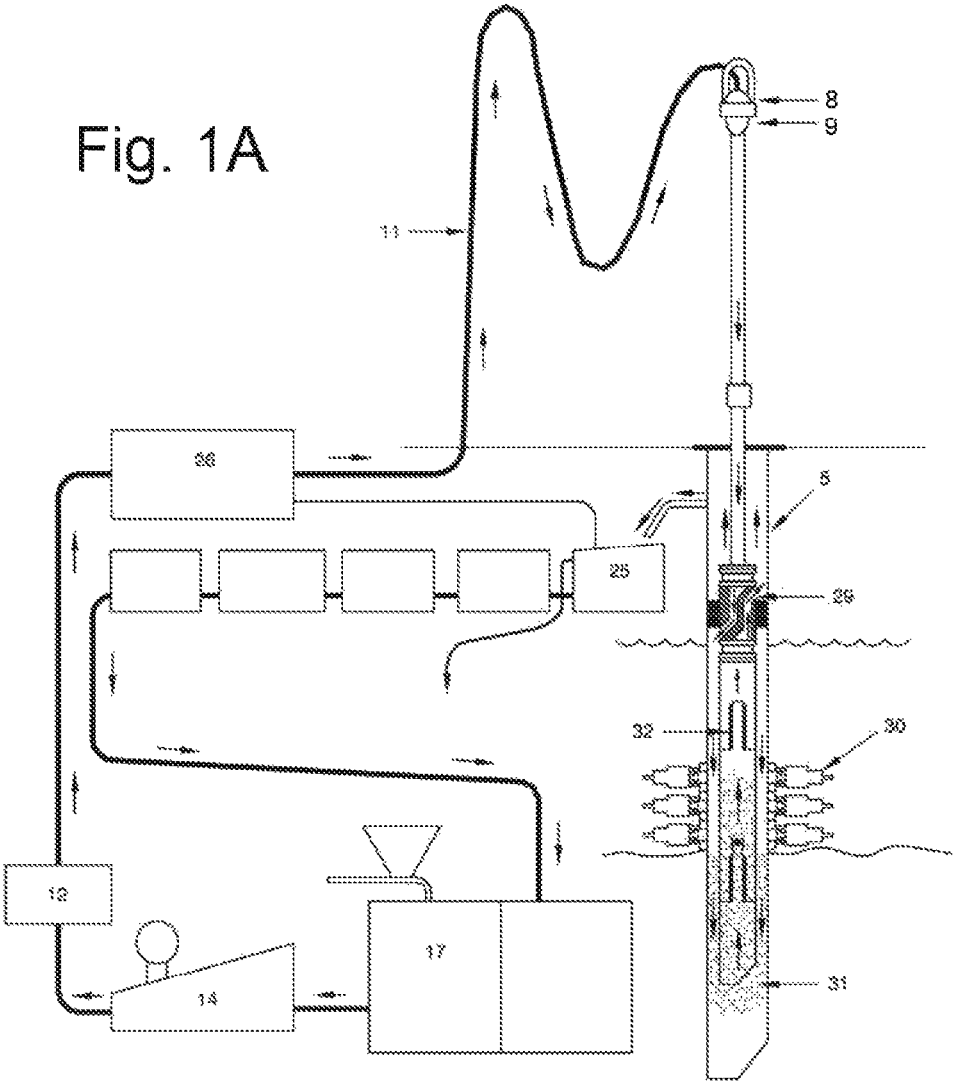
FIG. 1A is a diagram showing incorporation of the Bi-Directional Chamber Trap (BDCT), Marine Riser Reversing Tool (MRRT), and Washpipe Debris Trap (WPDT) into a well system in one embodiment of the present invention.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "couple," "coupling," "coupled," "coupled together," and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface. It will also be appreciated by one skilled in the art that the inventions described herein may apply to various types of tubulars well known in the art for both off and on shore rigs. Accordingly, as used herein, the terms "drill pipe," "washpipe," and "tubing" may be used interchangeably where appropriate. Further, the terms "casing" and "riser" may be used interchangeably where appropriate.

Generally, the term "tubular" may be used to refer to a liner, a casing, a washpipe, a drillpipe, or another other long, hollow, substantially-cylindrical structure. The present invention may be used with various types of tubulars. Accordingly, the terms "washpipe," "washpipe pup," "liner," "tubing," "drillpipe," and "casing" may be used interchangeably. Further, it is expressly understood that although the figures depict only certain types of tubulars, the invention is not limited to these embodiments.

In a preferred embodiment of the present invention, an improved well system and method of operating the well system is provided by the incorporation of novel tools: the Washpipe Debris Trap (WPDT), the Debris Trap In-Line Filter (DPDT), the Marine Riser Reversing Tool (MRRT), and the Bi-Directional Chamber Trap (BDCT). As will be appreciated by one skilled in the art, the three tools integrate seamlessly into prior art well systems, such as the well systems shown in FIGS. 1 and 6, to provide improved down hole cleaning processes, improved monitoring of sand control system integrity, and improved filtration of fluid entering and exiting the well.

Figure 1B:
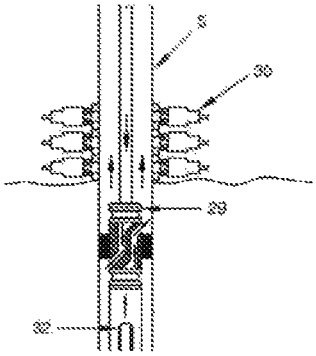
FIG. 1B is a diagram showing the position of the MRRT and the WPDT relative to a blow out preventer in a well system in one embodiment of the present invention.

Several configurations of the three tools can be utilized in a well system. FIG. 1A depicts one embodiment of the system incorporating three tools, with the MRRT and WPDT being positioned above the Blow Out Preventers (BOP). FIG. 1B depicts yet another embodiment of the system where the MRRT and WPDT are positioned below the BOPs 30. Referring back to FIG. 1A, it will be appreciated that the MRRT 29, BDCT 26, and WPDT 32 can be incorporated into prior art well systems. The manner in which the MRRT, BDCT, and WPDT incorporate into and function within a well system is more fully described below.

It will further be appreciated that different combinations of one or more MRRT, BDCT, and/or WPDT will be utilized by various embodiments of the present invention. For example, in one embodiment of the invention, the MRRT and WPDT may utilized in conjunction with one another to facilitate interval specific wellbore clean out in a well system, such as across the BOP, gas lift mandrels, or chemical injection mandrels. In another embodiment of the present invention, the WPDT may be utilized with one or more BDCTs in order to provide a last line of defense against debris being pumped into and out of a well system, which would potentially damage sensitive well equipment. In yet another embodiment of the present invention, the MRRT may be utilized in conjunction with currently existing tools to minimize annular fluid loss when a formation is exposed. It will be appreciated that other combinations exist, and the above disclosure is for the purpose of example only.

A. Washpipe Debris Trap

The Washpipe Debris Trap (WPDT) aspect of the present invention may be used in systems and methods for drilling and completion of wells. Some embodiments of the WPDT may be particularly useful in drilled wells in offshore environments and other environments where formation sand production is prevalent, however it will be appreciated by one skilled in the art that use of the WPDT will be beneficial in any environment where proppant, debris of a granular nature, or formation sand is present and/or sand control measures are being taken.

In a preferred embodiment of the present invention, the WPDT serves as an indicator of a sand control system integrity breach during a sand control job by trapping sand that has breached sand control measures as it moves into the WPDT and up the washpipe towards the crossover tool. The WPDT provides the additional benefit of preventing sand that has breached the sand control screens from traveling up the washpipe through the crossover tool and reaching the annular space above the sand control packer between the casing and the workstring/service tool assembly. It will be appreciated that use of some embodiments of the WPDT will both indicate that a breach has occurred and will mitigate damage resulting from such breach until such breach can be remedied.

Figure 2A:
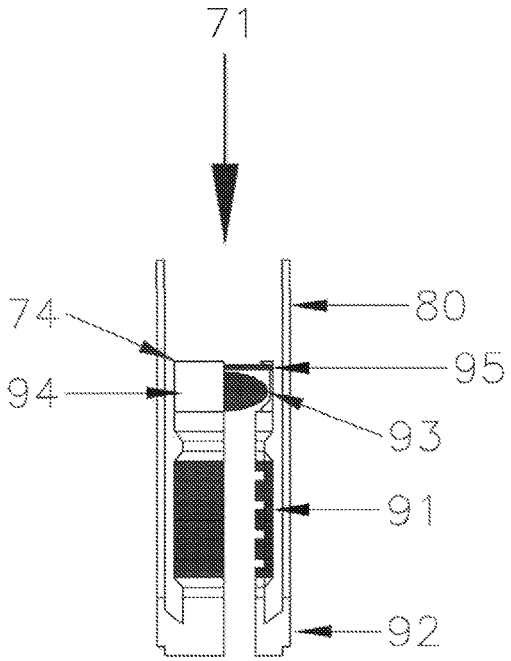
FIG. 2A is a cross-sectional view of a lower assembly of the WPDT in one embodiment of the present invention.
Figure 2B:
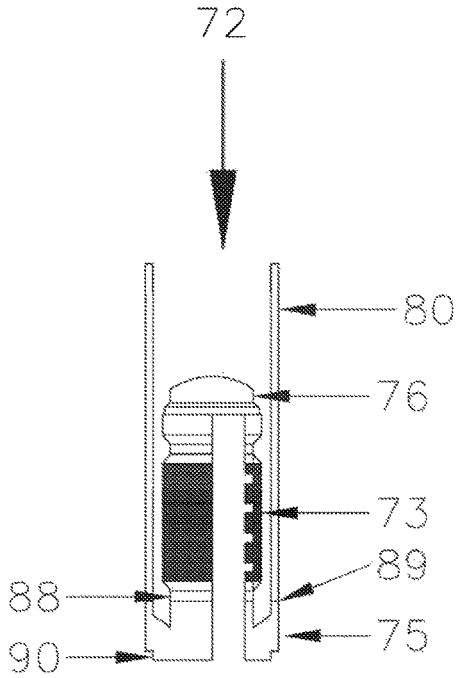
FIG. 2B is a cross-sectional view of an upper assembly of the WPDT in one embodiment of the present invention.

Referring now to FIGS. 2A and 2B, in a preferred embodiment of the present invention, WDPT 32 is comprised of upper assembly 72 and lower assembly 71. In this embodiment, upper assembly 72 is comprised of screen 73, bull plug 76, and 3-way adapter 75. In a preferred embodiment, screen 73 is a thru-tubing screen that is of an appropriate size, diameter, tensile, burst, collapse, and gauge to be placed within washpipe pup 80, such as the DeltaPore HP™, manufactured by Delta Screens. Bull plug 76 is coupled to one end of screen 73 through standard coupling means, such as threading. A bull plug is well known in the art, such as the Mayco bull plug. 3-way adapter 75 contains three coupling locations: an inner coupling location 88, a screen-facing outer coupling location 89, and a non-screen-facing outer coupling location 90. In some embodiments of the present invention coupling locations 88-90 will be a Hydrill 511 box/pin coupling. It will be appreciated by those skilled in the art that other embodiments will use other coupling means. Inner coupling location 88 of 3-way adaptor 75 is coupled to the end of screen 73 that is not coupled to bull plug 76. 3-way adapter 75 also provides a means to couple a washpipe pup 80 to either or both of screen-facing 89 and non-screen facing 90 outer couplings. In a preferred embodiment, 3-way adapter 75 is constructed of fairly hard material with some corrosion resistance which is readily machineable, such as A519-4140 in grade P110. It will be appreciated that other satisfactory materials exist and can be used to construct 3-way adapter 75.

In a preferred embodiment, lower assembly 71 is comprised of screen 91, 3-way adapter 92, and ball check valve 74. Screen 91 and 3-way adapter 92 of lower assembly 71 may be identical to those of upper assembly 72 in some embodiments. In other embodiments, they may be of different sizes or dimensions. In a preferred embodiment, ball check valve 74 may be comprised of ball 93 which is of very hard and corrosion resistant material, valve body 94, and ball keeper pin 95. In the preferred embodiment, valve body 94 will be made from A519-4140 in grade P110. It will be appreciated that other satisfactory materials exist and can be used to construct the valve body. The inclusion of ball keeper pin 95 in ball check valve 74 allows ball 93 to be changed if necessary, thus prolonging the life of ball check valve 74. In other embodiments, ball check valve 74 may be a Mingo Manufacturing ball check valve, or other commercially available ball check valve. Ball check valve 74 is coupled to one end of screen 91 of lower assembly 71 through standard coupling means, such as threading. The other end of screen 91 is coupled to inner coupling location 88 of 3-way adapter 92 of lower assembly 71. As disclosed above, washpipe pup 80 may be coupled to either or both of screen-facing 89 and non-screen-facing 90 outer coupling locations of 3-way adapter 92. In a preferred embodiment, washpipe pup 80 is coupled to screen-facing outer coupling location 89 of both upper 72 and lower 71 assemblies, creating an enclosed chamber 96 between lower 71 and upper 72 assemblies.

Figure 3:
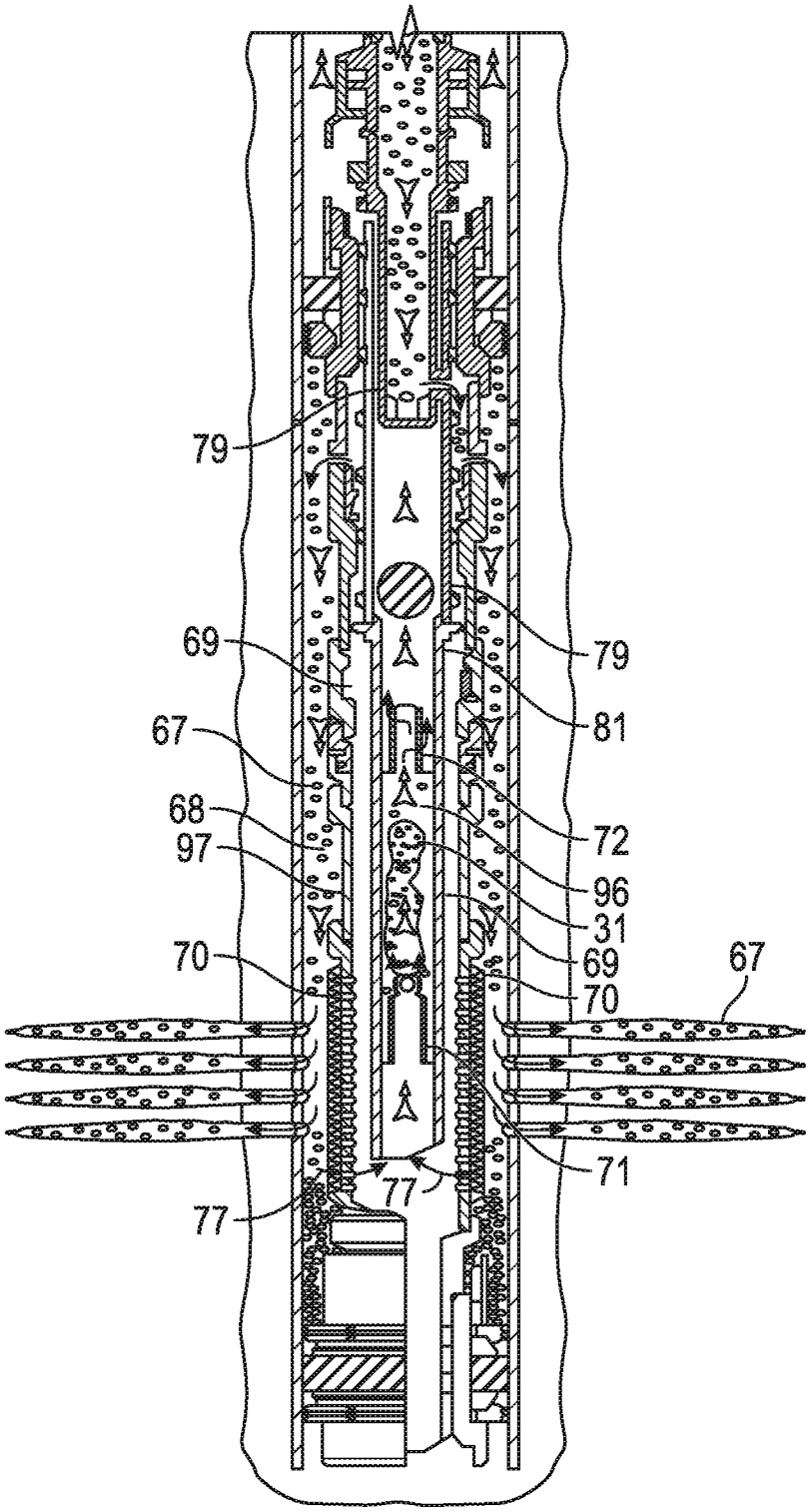
FIG. 3 is a cross-sectional view of the WPDT during a sand control job in one embodiment of the present invention.

Referring now to FIG. 3, in a preferred embodiment of the present invention, WPDT 32 is utilized in conjunction with a crossover tool 79 on a sand control job in a wellbore. In this embodiment, WPDT 32 is coupled to washpipe 81 located down well from crossover tool 79 in the sand control bottom hole assembly, and inside of sand control screen base pipes 97. It will be appreciated that both a casing/sand control screen annulus 68 and a sand control screen/washpipe annulus 69 exist in this configuration.

Operation of WPDT 32 in a preferred embodiment is demonstrated by flow path 77. During a gravel-pack operation or other sand control jobs, proppant transport fluids are pumped down workstring to crossover tool 79. Flow path 77 continues into the crossover tool 79, where it is diverted into the casing/sand control screen annulus 68. As proppant transport fluid enters the casing/sand control screen annulus 68, proppant 67 does not pass screen 70 (if performing correctly) and begins to stack up in casing/sand control screen annulus 68. The gauge or micron size of screen 70 is selected to allow transport fluid to pass through while preventing proppant 67 from passing through. As proppant 67 continues to stack up, transport fluid flows through proppant 67 before flowing through screen 70 into sand control screen/washpipe annulus 69. Once in sand control screen/washpipe annulus 69, flow path 77 continues into WPDT 32 through screen 91 and ball check valve 74 of lower assembly 71.

In a preferred embodiment of the present invention, WPDT 32 will be positioned so that lower assembly 71 is positioned at the bottom of the sand control screen 70 to ensure an appropriate return circulation point. Flow path 77 then continues through the chamber 96 of WPDT 32 and out screen 73 of upper assembly 72 into washpipe 81 and through the crossover tool 79. The gauge or micron size of screens 73, 91 of the lower and upper assemblies are preferably the same size as those of sand control screen 70 and/or selected to allow fluid to pass through while preventing proppant 67 to pass through.

To the extent a breach of the sand control system occurs, such as a breach of sand control screen 70, proppant 67 would then enter sand control screen/washpipe annulus 69. Flow path 77 would then carry proppant 67 into chamber 96 of WPDT 32 through ball check valve 74 of lower assembly 71. Flow path 77 then carries proppant 67 toward upper assembly 72, where proppant 67 would then be separated from the transport fluid due to the gauge or micron size of screen 73, in effect trapping proppant 67 inside chamber 96 of WPDT 32 between screens 73, 91 of upper 72 and lower 71 assemblies. Proppant 67 cannot pass back through screen 91 of the lower assembly, and additionally cannot leave chamber 96 due to ball check valve 74, which closes if there is a reverse flow or due to gravity when the forward flow stops.

When the sand control workstring is retrieved from the well, WDPT 32 can indicate whether a sand control breach exists. If there is proppant 67 in chamber 96 of WPDT 32, this will indicate that a breach may exist. Alternatively, if there is no proppant 67 in chamber 96 of WPDT 32, no breach exists. Such early detection allows a well operator to address the issue before more costly damage is done. In some embodiments of the WPDT, a well operator will be able to determine that WPDT 32 has trapped proppant 67 in chamber 96 before retrieving the sand control workstring from the well. For example, if there is a loss or reduction of fluid return at the surface, the operator will know that WPDT 32 should be returned to the surface to determine whether proppant 67 is trapped in chamber 96, thus indicating a breach of the sand control system.

Figure 4:
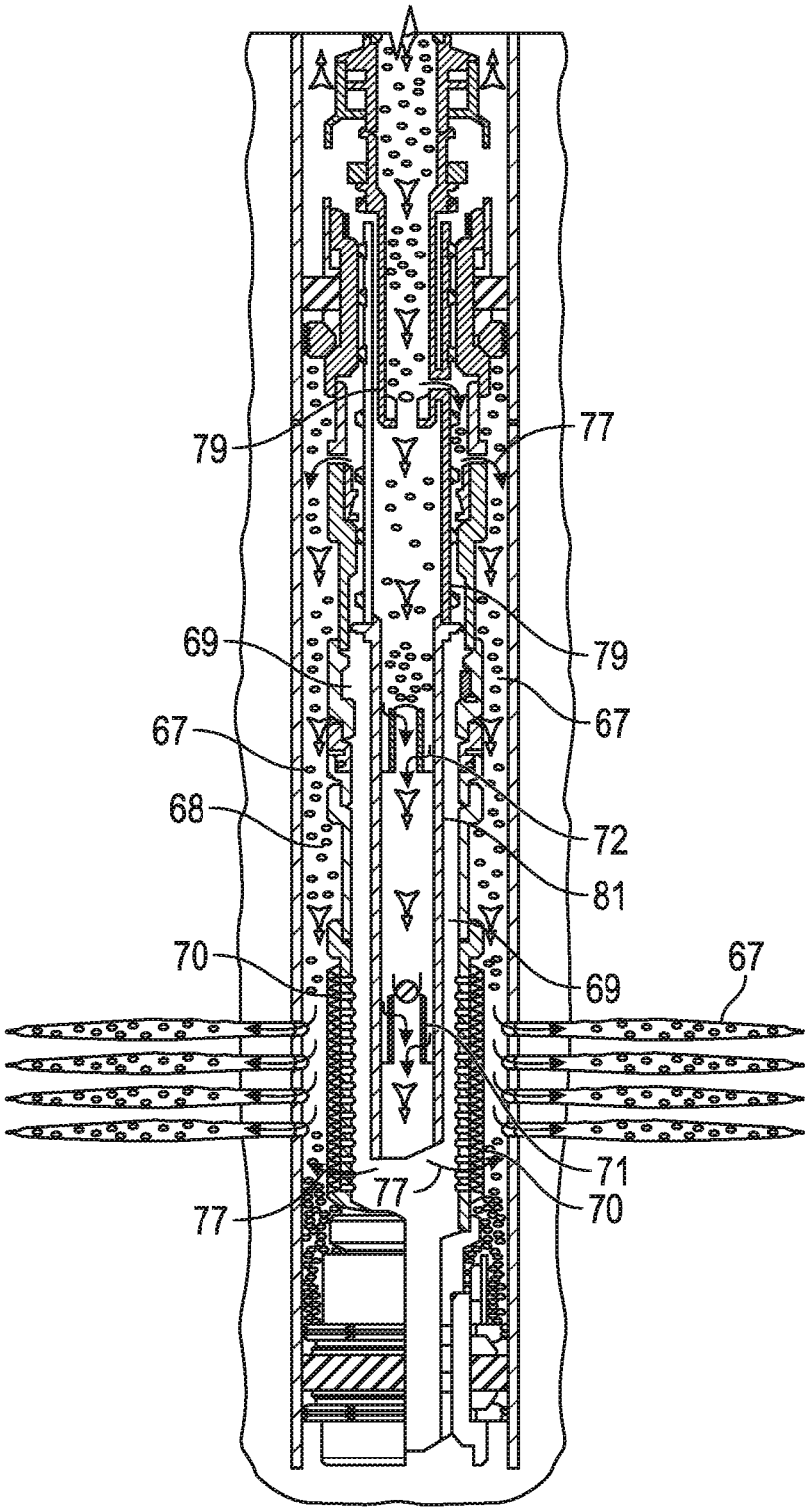
FIG. 4 is a cross-sectional view of the WPDT during a breach of the cross over tool in a sand control job in one embodiment of the present invention.

Referring now to FIG. 4, in some embodiments of the present invention, it will be appreciated that use of WPDT 32 will prevent proppant 67 transport fluid from entering the sand control screen/washpipe annulus 69 in the event of a crossover tool 79 failure. In the event of such a failure, proppant 67 will be separated from transport fluid as the proppant transport fluid travels down washpipe 81 and through screen 73 of upper assembly 72 of WPDT 32.

Figure 5A:
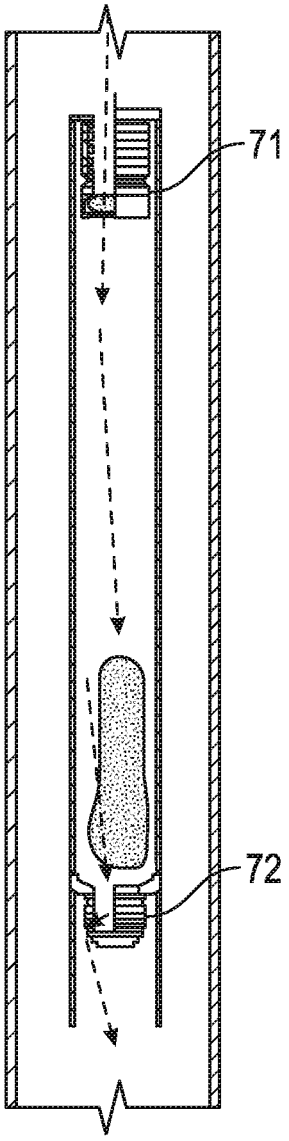
FIG. 5A is a cross-sectional view of the WPDT in a reversed position performing the role of a downhole BDCT in one embodiment of the present invention.
Figure 5B:
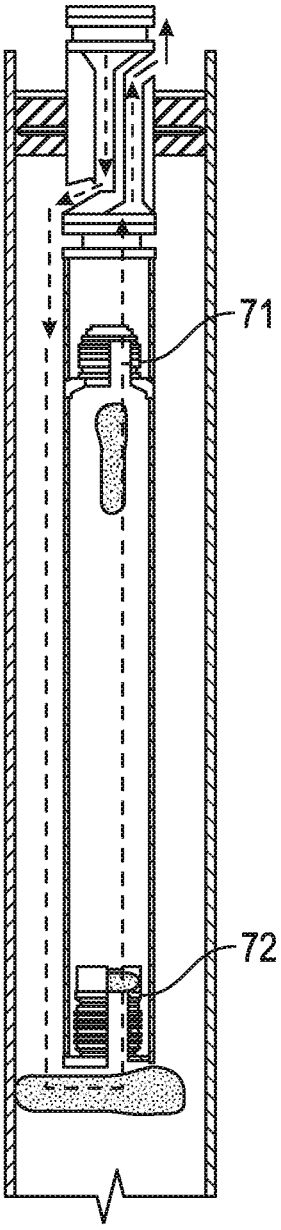
FIG. 5B is a cross-sectional view of the WPDT being used in conjunction with the MRRT in one embodiment of the present invention.

Referring now to FIGS. 5A and 5B, in yet another embodiment of the present invention, WPDT 32 may be used as a filter further up the workstring. In this embodiment, the WPDT is reversed such that lower assembly 71 is further up the workstring than upper assembly 72. In this embodiment, as fluid is pumped down the workstring, the fluid will flow through screen 91 of lower assembly 71. Any proppant 67, debris, or other material larger than the gauge of screen 91 of lower assembly 71 will pass through ball check valve 74 of lower assembly 71. Once the material passes through ball check valve 74 it will become trapped in chamber 96 of WPDT 32, as it will not pass through screen 73 of upper assembly 72. Fluid and materials smaller than the gauge of screen 73 of upper assembly 72 will continue to pass through WPDT 32 and down the workstring. Such an embodiment provides at least the benefits of preventing materials that would be harmful to downhole tools from travelling further down the well, as well as providing an indicator to the well operator that such materials are in the fluid being pumped once WPDT 32 is retrieved from the well. Further, this embodiment of the invention may be utilized as a space-saving alternative to the BDCT (described below), which can be beneficial to smaller offshore drilling rigs that do not have space available to place a BDCT on the rig. It will be appreciated that in other parts of the well or under specific conditions, MRRT 29 can behave similarly to crossover tool 79, as depicted in FIG. 5B.

The WPDT may be used as a standalone in-line filter at any depth within the well in any configuration with respect to the upper and lower screen assemblies. The screens may be sized as desired to accommodate the user's preference. Based on the configuration, the WPDT can accept flow during forward and reverse circulations. It may be inserted into any size workstring, drillpipe, or coiled tubing to act as a downhole in-line filter for fluid mediums passing through it.

The WPDT would be a space saving alternative for any surface debris filtration unit or downhole debris filtration or capturing tool. The two-piece design allows for customizable lengths and provides an ability to carry debris out of the well within its trap versus attempts to boost debris out of the well with varying diameters and pump rates.

Alternative embodiments of the WPDT may be used at any point in the systems described herein.

B. Debris Trap In-Line Filter (DPDT)

The Drillpipe Debris Trap In-Line Filter (DPDT) is an alternative embodiment of the WPDT. The DPDT is a simple and reliable in-line downhole debris capturing system that seamlessly integrates into workstring configurations for filtering surface and/or wellbore debris based on circulation path. In some embodiments of the present invention, the DPDT is installed on the deck of a drilling rig rather than downhole. This includes, but is not limited to drilling rigs, drilling platforms, pads, production facilities, workboats, ROV vessels, etc.

Figure 6A:
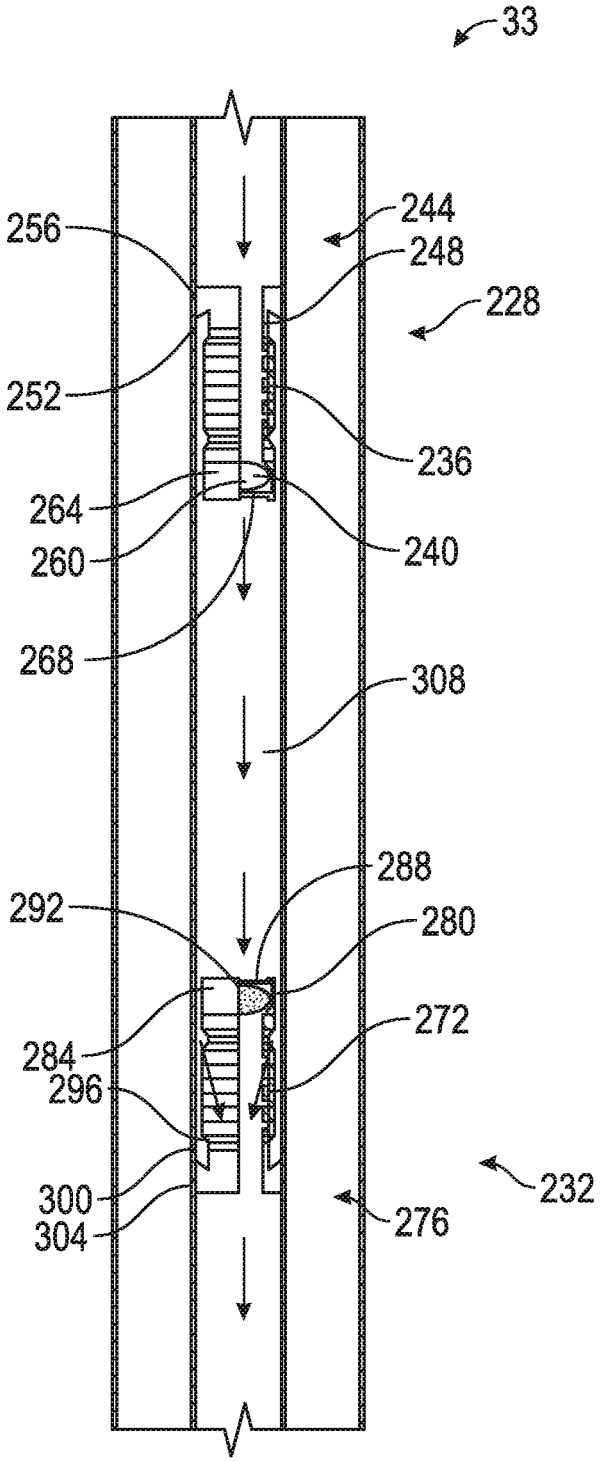
FIG. 6A is a cross-sectional view of a Drillpipe Debris Trap In-Line Filter (DPDT) in one embodiment of the present invention.
Figure 6B:
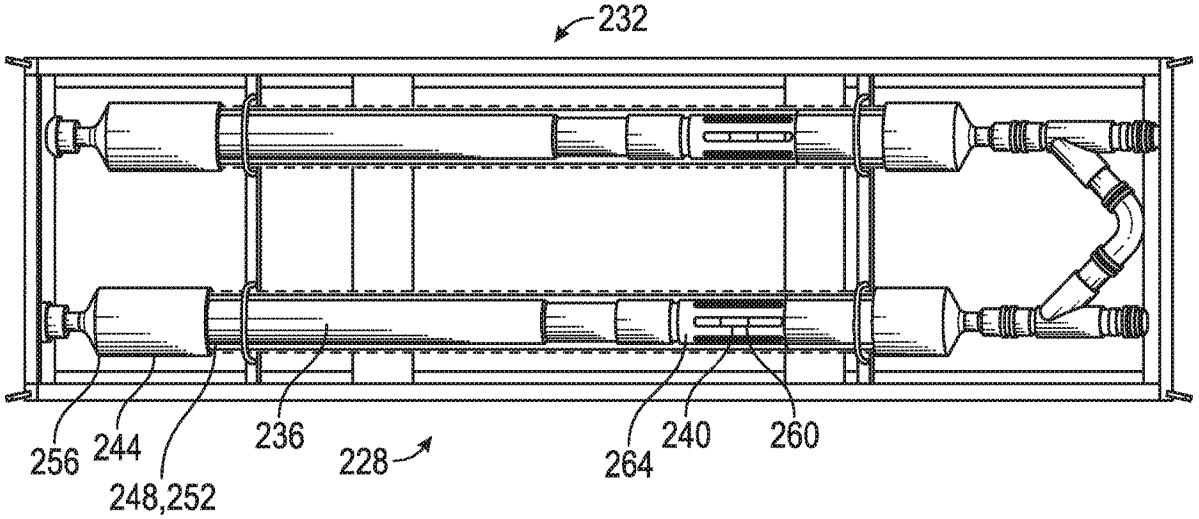
FIG. 6B is a front elevation view of a DPDT in another embodiment of the present invention.
Figure 6C:
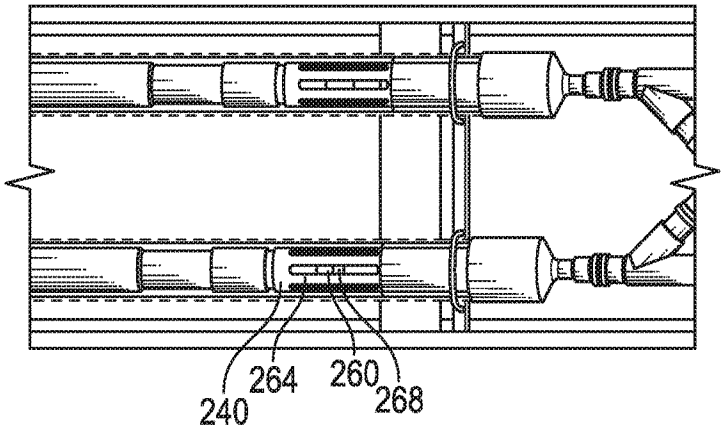
FIG. 6C is another front elevation view of the DPDT of the embodiment in FIG. 6B.

Referring now to FIG. 6A, in a preferred embodiment of the present invention, DPDT 33 is comprised of upper assembly 228 and lower assembly 232. In this embodiment, upper assembly 228 is comprised of screen 236, ball check valve 240, and 3-way adapter 244. In a preferred embodiment, screen 236 is a thru-tubing screen that is of an appropriate size, diameter, tensile, burst, collapse, and gauge to be placed within washpipe pup, tubing, casing, drillpipe, or other suitable conduit, such as the DeltaPore HP™, manufactured by Delta Screens, or any other conduit. 3-way adapter 244 contains three coupling locations: an inner coupling location 248, a screen-facing outer coupling location 252, and a non-screen-facing outer coupling location 256. In some embodiments of the present invention coupling loacations 248, 252, 256 will be a Hydrill 511 box/pin coupling. It will be appreciated by those skilled in the art that other embodiments will use other coupling means. Inner coupling location 248 of 3-way adaptor 244 is coupled to the end of screen 236 that is not coupled to ball check valve 240. 3-way adapter 244 also provides a means to couple a washpipe pup or other conduit to either or both of screen-facing 252 and non-screen facing 256 outer couplings. In a preferred embodiment, 3-way adapter 244 is constructed of fairly hard material with some corrosion resistance which is readily machineable, such as A519-4140 in grade P110. It will be appreciated that other satisfactory materials exist and can be used to construct 3-way adapter 244. In a preferred embodiment, ball check valve 240 may be comprised of ball 260 which is of very hard and corrosion resistant material, valve body 264, and ball keeper pin 268.

In a preferred embodiment, lower assembly 232 is comprised of screen 272, 3-way adapter 276, and ball check valve 280. In the preferred embodiment, valve body 284 will be made from A519-4140 in grade P110. It will be appreciated that other satisfactory materials exist and can be used to construct the valve body. The inclusion of ball keeper pin 288 in ball check valve 280 allows ball 292 to be changed if necessary, thus prolonging the life of ball check valve 280. In other embodiments, ball check valve 280 may be a Mingo Manufacturing ball check valve, or other commercially available ball check valve. Ball check valve 280 is coupled to one end of screen 272 of lower assembly 232 through standard coupling means, such as threading. The other end of screen 272 is coupled to inner coupling location 296 of 3-way adapter 276 of lower assembly 232. As disclosed above, washpipe pup or other conduit may be coupled to either or both of screen-facing 300 and non-screen-facing 304 outer coupling locations of 3-way adapter 276. In a preferred embodiment, the washpipe pup is coupled to screen-facing outer coupling location of both upper 228 and lower 232 assemblies, creating an enclosed chamber 308 between lower 232 and upper 228 assemblies.

In one embodiment of the DPDT, the capturing zone is determined by the length of workstring between the two-piece system. For well conditioning with screen gauges customized to suit wellbore fluids, reverse circulation allows fluid to pass through the lower ball check and screen system and enter the capturing zone. The upper assembly, which utilizes a floating ball check valve that is closed by default, allows clean fluid to pass but not the debris or particulates the screens have been gauged for. Forward circulation pushes the floating upper ball check off seat and allows debris to enter the capturing zone, but eliminates the contamination of the wellbore from surface debris entering the well and causing unwanted downhole plugging as the lower ball-check seats and forces fluid to pass through the lower screen. This enhances thru-tubing work, acidizing, or other interventions where delicate equipment has already been installed.

In one embodiment, the DPDT is ideal for installation at surface or just below the rotary based on its simple ball check design, ability for bi-direction flow, and elimination typical footprints from deck mounted debris filtering equipment. Screens may be custom built and may be designed for large pit debris, filtering mud or brine, or capturing cuttings from within the wellbore. In some embodiments, where the DPDT is designed for 6⅝" drillpipe, the system can accommodate smaller strings with simple crossovers that may be installed prior to mobilization to eliminate the need for additional handling equipment on location. In other embodiments, the DPDT may be designed for drillpipe of sizes other than 6⅝" drillpipe.

In some embodiments, the DPDT is ideal for installation on the deck of an offshore drilling location. Such a deck-mountable embodiment provides easier access to equipment for maintenance and monitoring. Additionally, pressure differentials may be observed throughout the unit to provide immediate indication of plugging or the buildup of material captured. In some deck-mountable embodiments, the DPDT may be reconfigured to fit within a deck crate having predetermined dimensions. The DPDT can be run in a variety of configurations, allowing it to be contained within nearly any dimension of deck crate. Referring now to FIGS. 6B-6H, several views of one deck-mountable embodiment of the DPDT are shown. In some embodiments, deck-mountable DPDT 2100 may be comprised of substantially the same components as described above in regards to FIG. 6A. Other embodiments of the DPDT may practice the present invention with different or less components than those shown in FIG. 6A.

Figure 6D:
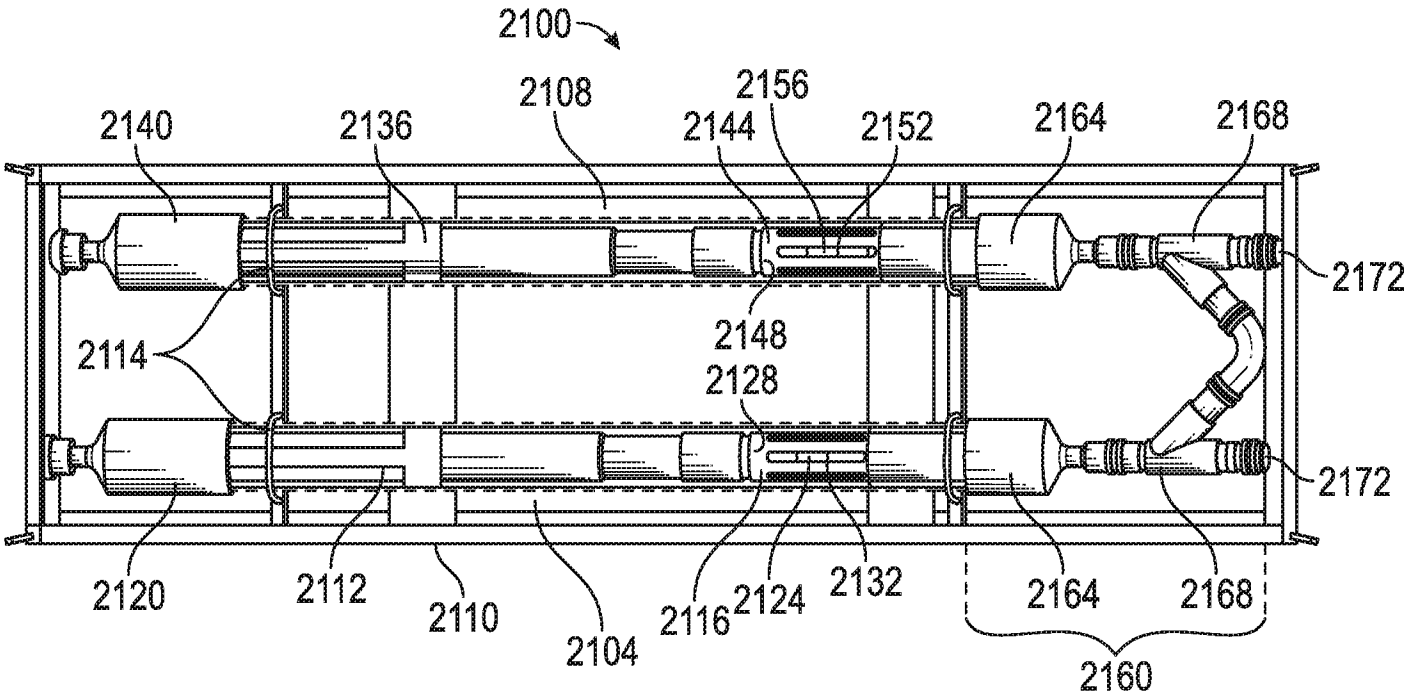
FIG. 6D is yet another front elevation view of the DPDT of the embodiment in FIG. 6B.
Figure 6E:
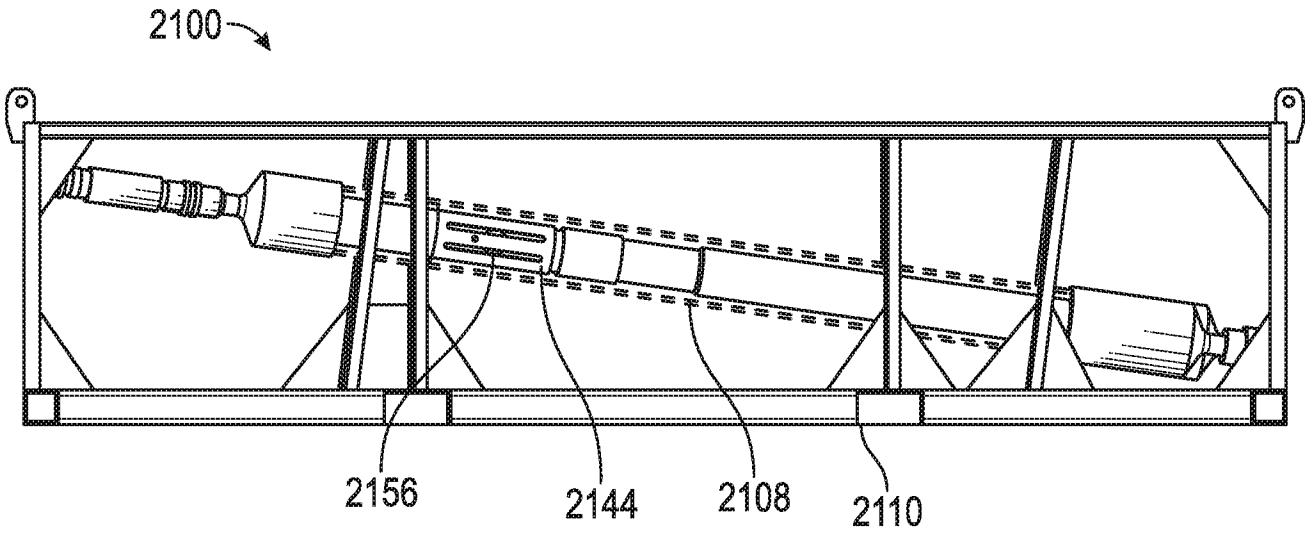
FIG. 6E is a side elevation view of the DPDT of the embodiment in FIG. 6B.
Figure 6F:
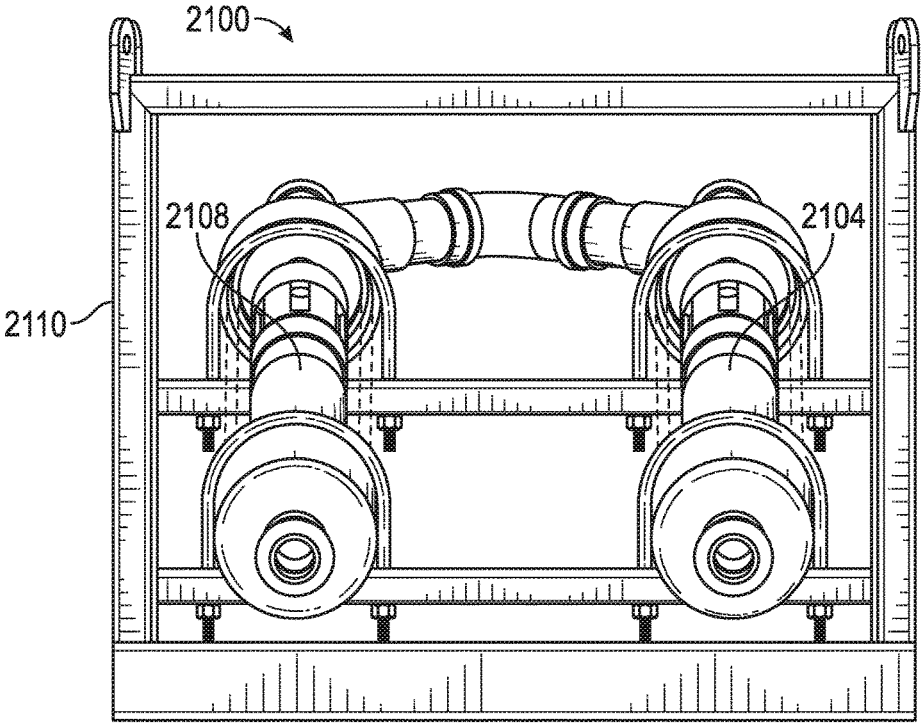
FIG. 6F is a bottom plan view of the DPDT of the embodiment in FIG. 6B.
Figure 6G:
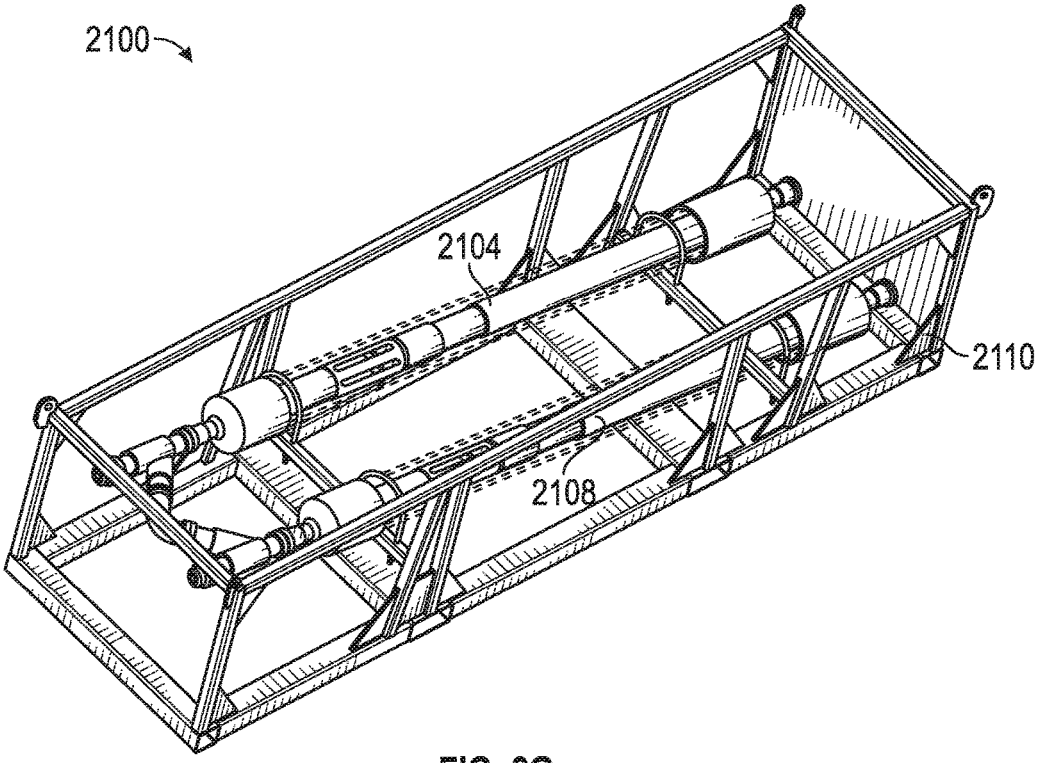
FIG. 6G is a perspective view of the DPDT of the embodiment in FIG. 6B.
Figure 6H:
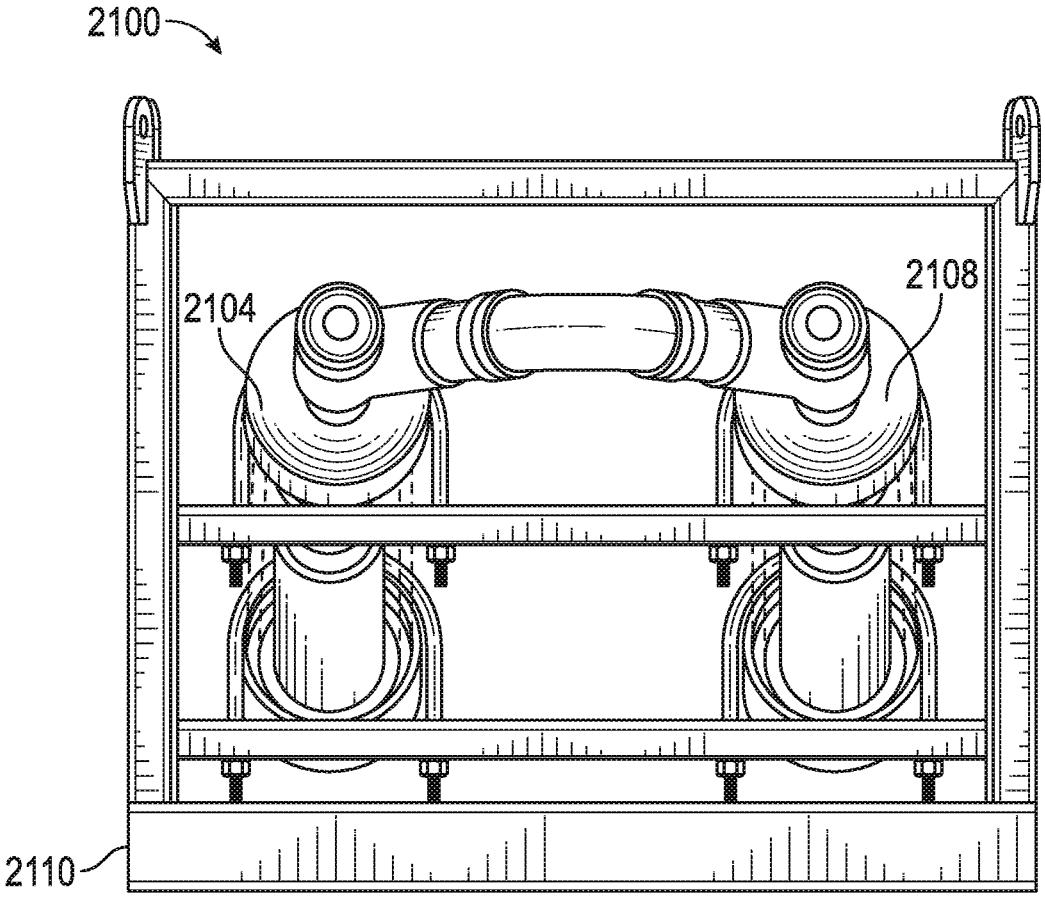
FIG. 6H is a top plan view of the DPDT of the embodiment in FIG. 6B.

Referring now to FIG. 6D, Deck-mountable DPDT 2100 is comprised of upper assembly 2104 and lower assembly 2108. In some embodiments, upper assembly 2104 and lower assembly 2108 may be secured to deck crate 2110 by securing means 2114. Securing means 2114 can be u-bolts or other suitable means for securing upper assembly 2104 and lower assembly 2108 to deck crate 2110. In this embodiment, upper assembly 2104 is comprised of screen 2112, ball check valve 2116, and 3-way adapter 2120. In a preferred embodiment, screen 2112 is a thru-tubing screen that is of an appropriate size, diameter, tensile, burst, collapse, and gauge to be placed within washpipe pup, tubing, drillpipe, casing, or other suitable conduit, such as the DeltaPore HP™, manufactured by Delta Screens, or any other conduit. Similar to embodiments of the DPDT described with respect to FIG. 6A above, 3-way adapter 2120 contains three coupling locations (not shown in FIG. 6D): an inner coupling location, a screen-facing outer coupling location, and a non-screen-facing outer coupling location. In some embodiments of the present invention, the coupling means will be a Hydrill 511 box/pin coupling, API 8RD box/pin GTM 69, or as required for operational conditions. It will be appreciated by those skilled in the art that other embodiments will use other coupling means. Inner coupling location of 3-way adaptor 2120 is coupled to the end of screen 2112 that is not coupled to ball check valve 2116. 3-way adapter 2120 also provides a means to couple a washpipe pup or other conduit to either or both of screen-facing and non-screen facing outer couplings. In a preferred embodiment, 3-way adapter 2120 is constructed of fairly hard material with some corrosion resistance which is readily machineable, such as A519-4140 in grade P110. It will be appreciated that other satisfactory materials exist and can be used to construct 3-way adapter 2120. In a preferred embodiment, ball check valve 2116 may be comprised of ball 2124 which is of very hard and corrosion resistant material, valve body 2128, and ball keeper pin 2132.

In a preferred embodiment, lower assembly 2108 is comprised of screen 2136, 3-way adapter 2140, and ball check valve 2144. In the preferred embodiment, valve body 2148 will be made from A519-4140 in grade P110. It will be appreciated that other satisfactory materials exist and can be used to construct the valve body. The inclusion of ball keeper pin 2152 in ball check valve 2144 allows ball 2156 to be changed if necessary, thus prolonging the life of ball check valve 2144. In other embodiments, ball check valve 2144 may be a Mingo Manufacturing ball check valve, or other commercially available ball check valve. Ball check valve 2144 is coupled to one end of screen 2136 of lower assembly 2108 through standard coupling means, such as threading. The other end of screen 2136 is coupled to inner coupling location (not shown) of 3-way adapter 2140 of lower assembly 2108. As disclosed above, a washpipe pup or other conduit may be coupled to either or both of screen-facing and non-screen-facing outer coupling locations (not shown) of 3-way adapter 2140.

In some embodiments, a washpipe pup is coupled to screen-facing outer coupling location of both upper 2104 and lower 2108 assemblies, creating an enclosed chamber between lower 2104 and upper 2108 assemblies. In other embodiments of deck-mountable DPDT 2100, such as the embodiment shown in FIGS. 6B-6H, upper/lower assembly bridge 2160 connects upper 2104 and lower 2108 assemblies, creating an enclosed chamber between lower 2104 and upper 2108 assemblies. Upper/lower assembly bridge 2160 may be further comprised of crossover subs 2164, bridge subs 2168, and drain plugs 2172. Crossover subs 2164 may be used to couple the washpipe pups or other conduits of lower 2104 and upper 2108 assemblies to bridge subs 2168. Bridge subs 2168 may be coupled together to establish an enclosed chamber between lower 2104 and upper 2108 assemblies. In a preferred embodiment, bridge subs 2168 may be constructed of high pressure iron such as 3 inch 1502 weld iron. It will be appreciated that other satisfactory materials exist and can be used to construct bridge subs 2168. In some embodiments, drain plugs 2172 may be removed to allow for removal of debris or washing of the deck-mountable DPDT without complete disassembly.

It will be appreciated by those skilled in the art that the above description of various aspects of various embodiments of the WPDT may be applied to the various embodiments of the DPDT, and that various aspects of various embodiments of the DPDT may be applied to the various embodiments of the WPDT.

C. Marine Riser Reversing Tool

The Marine Riser Reversing Tool (MRRT) aspect of the present invention may be used in systems and methods for cleaning the internal surface of riser pipes used for drilling, interventions, and completion/workovers of offshore wells. The MRRT overcomes issues presently found in existing cleaning systems and methods including reliance on booster pumps, large annular cross-sectional areas for carrying fluid and debris out of the well, chemical contact times, riser margin limitations, and underbalance management. The MRRT permits reverse circulation of the riser at reduced pump rates without compromising debris carrying capacity. The lower pump rate in turn permits longer contact time between chemicals and the riser wall. Formulations of the chemicals may be adjusted to capitalize on the slower pump rates and the ability to allow chemicals to do more work before returning to the surface.

The MRRT may work in conjunction with existing tools in closed and open systems. In a closed system, concerns of pumping debris beyond the point of entry into a drill pipe are minimized based on the depth of the point of entry into the drill pipe and the top of the installed isolation. An open ended point of entry into the drill pipe (mule shoe, bull nose, etc.) may be used to clean the top of the tree hardware (caps, crown plugs, etc.). In an open system, several debris-catching technologies may be utilized, including a junk basket, a non-ported MRRT, or a tool similar to the Well Patroller. A port of entry would lie above these tools. Utilizing the MRRT causes different fluid velocities and pressures at different locations in the workstring. However, use of the MRRT should not cause any unwanted pressure increases at the surface of the well. Regardless, monitoring the drill pipe pressure provides an indication of any plugging from the MRRT or additional tools utilized.

It will be appreciated by one skilled in the art that use of a preferred embodiment of the present invention incorporating the MRRT will be particularly beneficial in an offshore drilling environment where drilling fluids have a tendency to congeal within the riser pipe. However, other embodiments of the MRRT will provide a benefit in any environment where riser, casing, tubing, blow out preventers, trees, and well heads need to be cleaned out. Other embodiments of the MRRT will be beneficial in aiding sand washing, cementing, crown plug cleaning, BOP functioning and cleaning, open water displacements, downhole interval cleaning, whole conditioning, sand control service tool design, and coiled tubing applications.

The MRRT may be used at various depths in a well operation. The MRRT may be placed at various depths in the borehole based on well configuration, inserted equipment depth, and/or riser characteristic limitations. The MRRT may be run below the tree at various well depths to conduct additional cleaning operations. In addition, reciprocation and rotation of a workstring equipped with the MRRT is contemplated. Specifically, the workstring may travel uphole, travel downhole, and rotate while the MRRT remains stationary.

Figure 7:
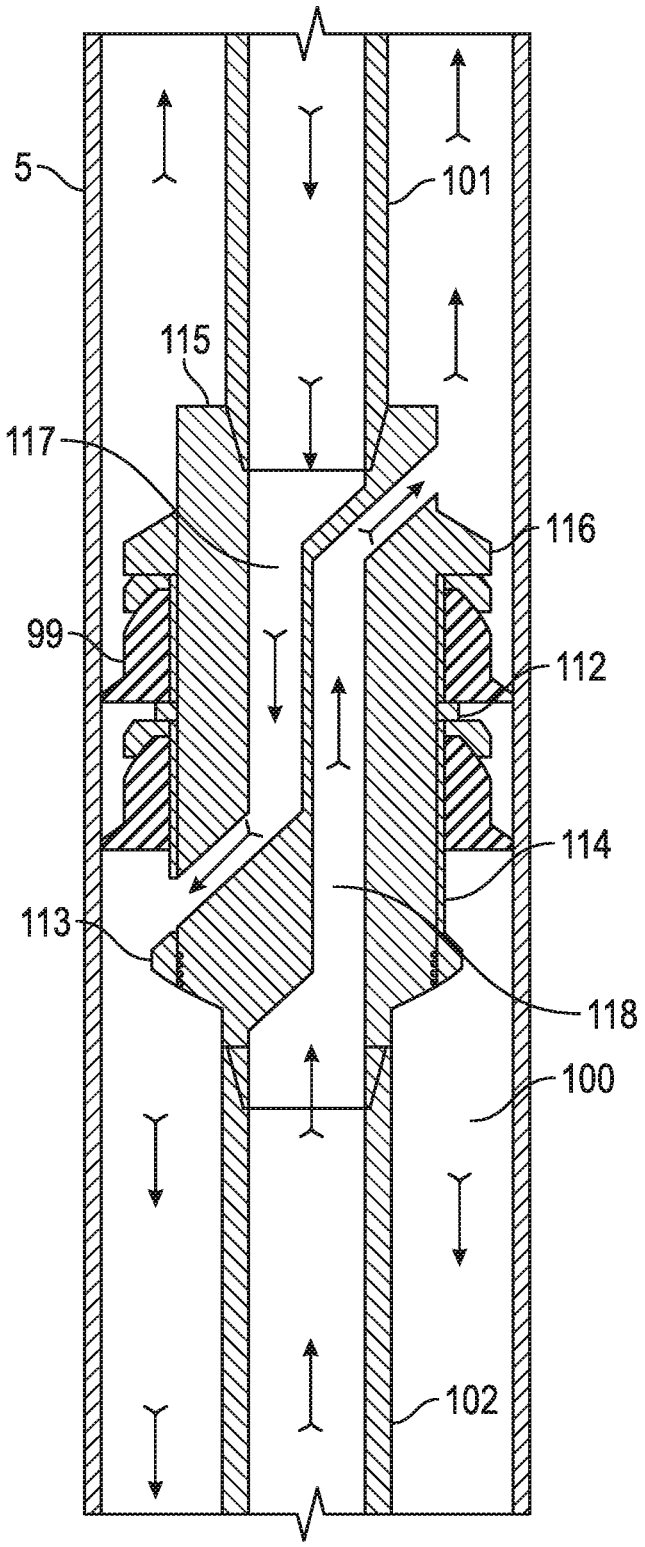
FIG. 7 is a detailed, cross-sectional view of the MRRT in one embodiment of the present invention.

Referring now to FIG. 7, in a preferred embodiment of the present invention, MRRT 29 is comprised of a cylindrical tool placed within a sealing element 99, creating two workstring/riser annuli 100, one above and one below the sealing element 99. In a preferred embodiment, the body of MRRT 29 is comprised of mandrel 115. Two channels run lengthwise through MRRT 29. These channels will be referred to as downward channel 117 and upward channel 118. Each channel receives flow from the workstring and outputs the flow into the workstring/riser annulus. Downward channel 117 receives fluid or other material from upper tubing string 101, and outputs that fluid or other material into workstring/riser annulus 100 below sealing element 99. Upward channel 118 receives fluid or other material from lower tubing string 102, and outputs that fluid or other material into workstring/riser annulus 100 above sealing element 99. Since the fluid returns to the annulus 100 above the sealing element 99, the velocity of the fluid decreases because the annulus 100 has a larger cross sectional area than interior of the workstring. Junk baskets may be employed in the annulus 100 above the sealing element 99 to capture any debris that is not carried to the surface due to the reduced velocity. The junk baskets would be such that the annular space 100 would be minimized to permit maintenance of velocities comparable to those inside of the workstring. A pin by box connection, as is commonly used in the oil and gas industry, may be used to selectively interconnect the MRRT 29 to a workstring.

In a one embodiment of the present invention, sealing element 99 comprises cup elements that seal MRRT 29 to the riser's 5 internal diameter and separates the annulus above the MRRT 29 from the annulus below the MRRT 29. Sealing element 99 is further comprised of spacer ring 112, retaining nut 113, packer sleeve 114, and packer stop 116. Packer sleeve 114 is a cylinder to which packing cups are affixed. Packing cups may be visually inspected for complete bonding, and a pry test may be performed to ensure full adhesion. Spacer ring 112 fills the void between the two packing cups that are affixed to packer sleeve 114. Packer sleeve 114 then slides on top of mandrel 115 and is held in place by packer stop 116 on the top side and retaining nut 113 on the bottom side. In another embodiment of the present invention an inflatable element package with a control line run to surface to control inflating/deflating of the element is also located in the same place as cup elements.

Figure 8A:
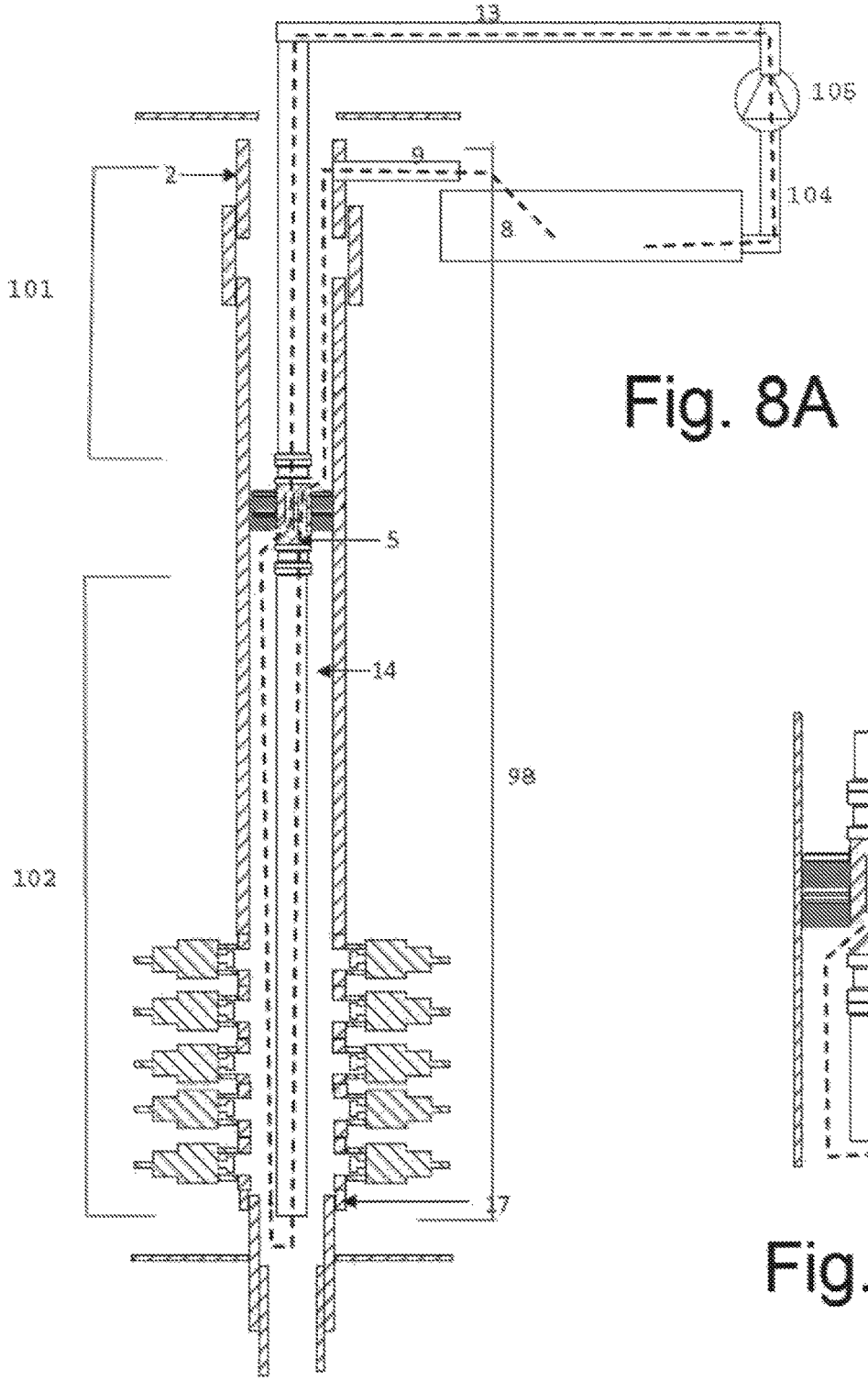
FIG. 8A is a cross-sectional view of the MRRT during a riser cleaning job in one embodiment of the present invention.
Figure 8B:
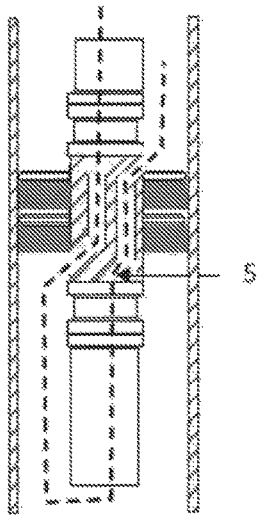
FIG. 8B is a detailed cross sectional view of the MRRT during a riser cleaning job in one embodiment of the present invention.

In one embodiment of the present invention, MRRT 29 is positioned in the well above the zone that needs to be cleaned. FIGS. 8A and 8B depict the MRRT positioned in the riser 5, however the MRRT can be placed in tubing or casing as well in some embodiments. MRRT 29 is placed in workstring 98 along with its sealing element 99, creating a workstring/riser annulus 100 above and below MRRT 29. Additionally, placement of MRRT 29 creates an upper tubing string 101 and a lower tubing string 102. Some embodiments of the MRRT 29 are simple such that the MRRT 29 could be run without the need for an expert on location and with parts capable of replacement on location without specialty tools. Various embodiments of the MRRT 29 may be compatible with existing well bore clean out technology and may contain a means to be quickly removed in the event of well control events. In view of the compatibility, the connection between the MRRT 29 at the drillstring at large may be a common 7⅝" API REG Box X Pin. The use of a large and common API connection gives the ability to crossover to the other possible sizes and connections of workstrings, tubing, washpipe, etc. without the need for additional mandrel inventory. This standardization, for example, the lack of premium threads, also affects production costs.

MRRT 29 is part of a circulation system that flows from tank 8 through suction line 104 to pump 105. Pump 105 moves cleaning fluid through pump line 13 to the upper tubing string 101 above sealing element 99. The cleaning fluid travels down the upper tubing string 101 to MRRT 29. Once the cleaning fluid reaches MRRT 29, the flow crossover function of MRRT 29 diverts the cleaning fluid from upper tubing string 101 to workstring/riser annulus 100 below sealing element 99. The cleaning fluid then makes direct contact with the riser zone that is intended to be cleaned. Cleaning fluid and coagulated fluid and debris that is cleaned off the riser continues to travel down the lower workstring/riser annulus 99 to the bottom of the well. The fluid reenters lower tubing string 102 and travels up lower tubing string 102 to MRRT 29, where flow is again diverted, causing the fluid to enter the workstring/riser annulus 100 above sealing element 99. Fluid continues to travel up upper workstring/riser annulus 100 to flow line 9 and then back to tank 8 in the surface circulating system.

It will be appreciated that because the cleaning fluid and coagulated fluid and debris that are cleaned off riser 5 travels up the lower tubing string 102, much lower pressure and consequently annular velocity is required to bring the fluid and debris to the surface. In some embodiments, the magnitude of increased efficiency may be on the order of tenfold based on riser and workstring diameters. Such a reduction in required annular velocity provides several advantages. Higher annular velocities associated with traditional cleaning systems and methods increase the risks associated with mechanical failure of associated equipment and decrease efficiency of surface operations such as filtering. Further, use of MRRT 29 allows an operator to achieve operating pressures necessary for proper clean-up irrespective of seabed depth. Other advantages of using MRRT 29 for cleaning operations include: aiding in debris removal by allowing blow out preventers to be functioned while cleaning; cleaning above tree plugs and run an impression block downhole before running subsea test trees; and aiding in greener open water riser clean-ups.

Figure 9:
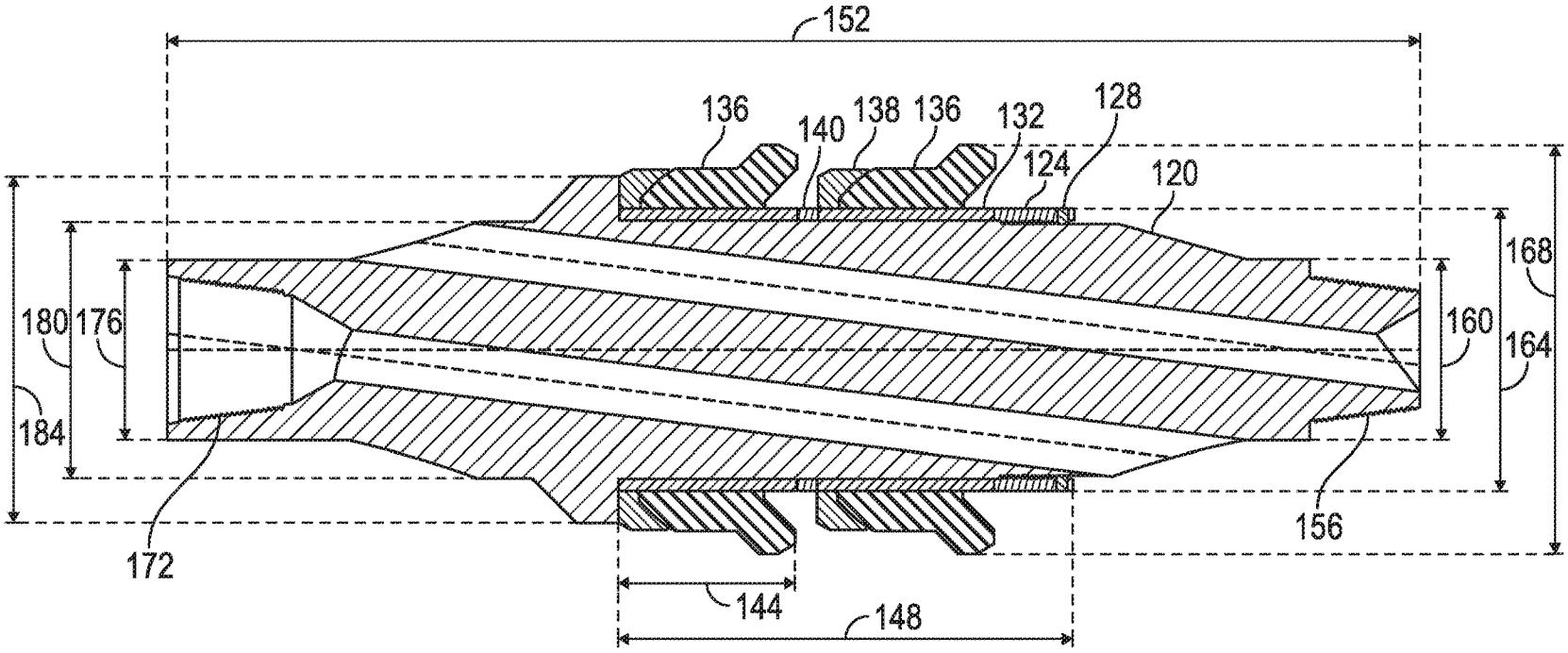
FIG. 9 is a cross-sectional view of the MRRT in one embodiment of the present invention.

Now referring to FIG. 9, additional views of the MRRT are provided. FIG. 9 is a cross-sectional view of the MRRT taken along a longitudinal plane of the MRRT. As described above, the body 120 of the MRRT has two ports that redirect the flow of fluid in a borehole. The large entrances and exits of these ports permit debris of nearly any size to pass through the MRRT. In addition, the generally tapering shape of the MRRT minimizes erosion of the MRRT. The ports are also sufficiently spaced apart from each other to minimize the effects of erosion between the ports. In other words, the material between the two ports is adequate to provide durability and extend the life of the MRRT over many cycles of use. Lastly, the ports are substantially oriented about a longitudinal axis and comprise no substantial bends, again, to minimize the effects of any erosion.

The embodiment of the MRRT in FIG. 9 comprises a retaining nut 124, a set screw 128, an o-ring 132, two cup seals 136, and a spacer sleeve 140. The set screw 128 may be coated with Blue Loctite and torqued to 35 ft-lbs to prevent the set screw 128 from backing downhole. The cup seals 136 are nitrile in a preferred embodiment. The cup seals 136, a cup retainer 138, the o-rings 132, and a cup sleeve are held in place on the body 120 of the MRRT by the spacer sleeve 140 and a retaining nut 124 with a set of backup screws.

The cup seal 136 has several design aspects and benefits. The MRRT has the ability to receive cup seals 136 of various sizes to accommodate multiple riser diameters without the requirement of a new body 120 design. In another embodiment, the MRRT comprises cup seals 136 of varying diameter. Thus, one cup seal 136 may accommodate a smaller diameter, and another cup seal 136 may accommodate a larger diameter. Embodiments of the MRRT and cup seals 136 may accommodate a differential pressure rating, for example, a minimum of 1,000 psi in excess of typical riser margins. Further, cup seals 136 are easily replaceable, self-setting, and self-sealing in various embodiments of the invention.

While a cup seal 136 is shown in FIG. 9, other seals such as an inflatable seal may be used. In some embodiments, a cup seal with an inner diameter of 2×2.5" and an outer diameter of 18.5" may accommodate a riser size of 19.5". Similarly, an inflatable seal may have an inner diameter of 2×2.5" and an outer diameter of 18.5" to accommodate a riser size of 19.5". Cup seals and inflatable seals may be de-rated to expected pressures, which would allow the seals to leak at specified pressures to eliminate a riser burst scenario.

The MRRT inflatable-type packer sleeve may provide, inter alia, (a) a differential pressure rating of, for example, a minimum 1,000 psi in excess of typical riser margins; (b) a reusable rubber element for entry through restrictions; (c) an alternative for users not comfortable with the reliability of the cup seal assembly design; and (d) a gateway into deeper downhole applications.

The cup seal 136 and/or the overall cup assembly may comprise a taper to aid in entering a casing or tubing. Further, the taper of the cup seal 136 helps the MRRT negotiate abnormalities in the well and prevent the cup seal 136 from overengaging slip joints. In addition, a riser brush may keep the MRRT centered in the casing or tubing, and a 18.75" bow spring centralizer may also be used to keep the MRRT centered in the casing or tubing.

Various components of the MRRT shown in FIG. 9 may have dimensional aspects. The cup seal length 144 may be approximately 8.5". However, in various embodiments the cup seal length 144 may be between approximately 4.0 and 18". The overall length of the cup assembly 148 may be approximately 21.75". It will be appreciated that in various embodiments, the overall length of the cup assembly 148 may be between approximately 12 to 36". Lastly, the overall length of the entire MRRT 152 may be approximately 60". However, in various embodiments, the overall length 152 may be between approximately 24 and 120".

The MRRT may have a male end 156 and a female end 172 based on those typically used in deep-water workstring applications with the ability to recut or crossover. For example, the male end 156 may be a 7⅝" API REG Pin. The male end 156 may have a first diameter 160 that is approximately 8.63", a second diameter 164 that is approximately 31.5", and third diameter 168 that is approximately 19.5". Conversely, the female end 172 may be a 7.⅝" API REG Box. The female end 172 may have a first diameter 176 that is approximately 8.63", a second diameter 180 that is approximately 12.25", and a third diameter 184 that is approximately 16.5". While these dimensions are based on an API Specification, it will be appreciated that the MRRT may accommodate other API standards or any other standards.

The various dimensions of the male end 156 and the female end 172 may be used to define a conduit cross sectional area and an annular cross sectional area. For example, the first diameters 160, 176 may define a conduit cross sectional area that is circular in shape and that ranges between the male end 156 and the female end 172. The conduit cross sectional area substantially corresponds to the conduit formed by a drillstring or drill pipe. Similarly, the second diameter 164 defines an outermost boundary of an annular cross sectional area while the first diameter 160, 176 define an innermost boundary of the annular cross sectional area. The annular cross sectional area also ranges between the male end 156 and the female end 172. The annular cross sectional area substantially corresponds to the annular spaced formed between the outer surface of a drillstring or drill pipe and the inner surface of a casing, a tubing, a riser, etc.

The design of the MRRT shown in FIG. 9 accommodates various design parameters and specifications. The MRRT body 120 may be resilient yet machineable 4140 alloy steel to help give the MRRT an exceptionally long operational life. The flow reduction areas of the body 120 may be designed with a 30 degree incident angle to help reduce perceived erosion at the reduction. Also, the ports may be designed with a diameter of 2.5" to help balance the reduction of velocities within the ports with wall thicknesses great enough to handle years of erosional wear.

Erosion calculations may be performed on the reduction areas as well as the ports to determine the approximate life of the body of the MRRT. In various embodiments, the assumptions made for erosion calculations may comprise: (a) brine fluid with a density of 1350 kg/m3 (11.27 lbs./gal) at 77° Fahrenheit, (b) 25 BBL/Min flow rate, (c) a sand content of 2% by unit volume, (d) a large sand grain size (250 microns), and (e) 3,000 psi differential pressure rating. Based on these assumptions and calculations, the MRRT tool should be capable of service for greater than 2 years of continuous flow. This would equate to greater than 26 million barrels of flow through each port prior to erosional communication within the tool. Assuming a flow volume of 6,000 barrels (4 hours at 25 BBL/Min) per clean out cycle; this would equate to over 4,000 cycles for the life of the tool.

While some preferred embodiments will utilize the above disclosed dimensions, it will be appreciated by those skilled in the art that other dimensions and specifications may be applied and utilized without departing from the scope of the invention is not limited to such dimensions and specifications.

Below is a table showing the characteristics of the components of an MRRT according to some embodiments of the present invention.

| Item | Material | Max OD in | Min ID in | Weight lbs | Collapse Rating psi | Burst Rating psi | Tensile Rating kips | Makeup Torque ft-lbs |
|---|---|---|---|---|---|---|---|---|
| Body | A-519 4140 Grade 110 | 16.520 | 2.500 | 1,453 | 36,820 | 55,215 | 2,288 | 66,285 |
| Retaining Nut | 1018 Cold Roll Steel | 13.510 | 12.070 | 22.77 | N/A | N/A | N/A | 200 |
| Set Screw | Alloy Steel Q&T | 0.500 | N/A | 0.06 | N/A | N/A | N/A | 35 |
| O-ring | Nitrile Rubber 70 Durometer | 12.375 | 12.000 | 0.05 | N/A | N/A | N/A | N/A |
| Cup Seal Sleeve | 1018 Cold Roll Steel | 13.510 | 12.340 | 55.33 | N/A | N/A | N/A | N/A |
| Cup Seal Retainer | 1018 Cold Roll Steel | 17.270 | 13.535 | 37.95 | N/A | N/A | N/A | N/A |
| Cup Seal Rubber | Nitrile Rubber 70 Durometer | 18.520 | 13.500 | 32.08 | N/A | N/A | N/A | N/A |
| Spacer Sleeve | 1018 Cold Roll Steel | 13.510 | 12.300 | 6.48 | N/A | N/A | N/A | N/A |

| Item # | QTY REQ Per MRRT | Description | Part Number |
|---|---|---|---|
| 1 | 1 ea | MRRT Body, 12.250" OD with 7-⅝" API REG Box X Pin Connections | SS-MRRT-1225-BODY |
| 2 | 1 ea | Retaining Nut | SS-MRRT-1350-RETN |

-continued

| | | | |
|---|---|---|---|
| 3 | 6 ea | Set Screw, ½"-13UNC C ¾" LG Cup Point Alloy Steel Cadmium Platted | SS-MRRT-0500-STSS |
| 4 | 4 ea | O-ring, Nitrile 70 Durometer Size 2-381 | SS-MRRT-1237-ORNG |
| 5 | 2 ea | Cup Seal Assembly 19.50" OD | SS-MRRT-1950-CSAS |
| 6 | 1 ea | Space Sleeve | SS-MRRT-1350-CPSL |

Various methods may be utilized to manufacture the MRRT of the present invention. In some embodiments, gundrilled ports are advantageous to avoid using ultiple components for the MRRT body 120. Using this method, the stock material may be larger than the final dimensions of the MRRT to allow for proper entrance and exit points for the gundrilling process. Four holes may be gundrilled into the stock material. Specifically, two holes correspond to two entrance ports, and two holes correspond to two exit ports. Precision is key as the entrance and exit hole for a given port will meet at the center of the stock material. Using multiple holes in this method stabilizes the gundrilled shaft and results in more accurately and precisely drilled ports, which is imperative in achieving quality flow paths. Custom jigs may be used to manipulate the entry points on the stock material to achieve the required exit angles. After the four holes are drilled, the stock material is turned down into the body profile.

In one specific embodiment of the present invention, the manufacturing process for the body 120 and the ports of the MRRT is as follows. (a) the stock material is placed into a horizontal boring mill and two 2.50" internal holes are drilled at a specified angle halfway through the body 120; (b) the stock material is then rotated 180 degrees end over end, and the internal holes are drilled from the other end meeting halfway for completion of holes through the body 120; (c) the material is inspected for accuracy of drilled holes for verification they meet precisely at the vertex of the two holes; (d) the outer diameter profile of the body 120 is then machined completely from both ends on a machine lathe; (e) 7⅝" API REG Box and Pin connections are machined at the two ends of the body 120 per API Specification 7-2,e.g., Eight Edition Jul. 1,2015; (f) the completed body 120 is inspected for verification of all dimensional tolerances. Between steps (d) and (e), a hardening may be performed to ensure a more consistent through hardening of the tool. In some embodiments, the hardening may be to 100 ksi.

The retaining nut, spacer sleeve, and sleeves required for the cup seal assembly are manufactured in an exemplary embodiment of the present invention as follows: (a) stock material is utilized and each item is machined completely on a machine lathe; (b) the machined items are inspected for verification of all dimensional tolerances.

The cup seal assembly may also be manufactured according to a specific process in some embodiments of the present invention. For example, a cup seal may be manufactured as follows: (a) the machined steel sleeves required for the cup seal assembly are placed into a pre-made compression tooling mold; (b) the rubber material is loaded and is molded and bonded to the steel sleeves utilizing a proprietary process; (c) the completed assembly is removed from the mold and inspected for all dimensional tolerances.

Once all of the components of the MRRT are manufactured, the components may be assembled into a complete MRRT. In some embodiments, the MRRT may be designed to have as few parts as possible and has no moving parts. The MRRT may be assembled per approved procedures which simply comprise sliding the cup seal assembly sleeves, spacer sleeve and retaining nut onto the body and tightening per recommended makeup torque. Six additional socket set screws built into the retaining nut may serve as a backup device to prevent it from backing off. Because of the weight of the MRRT body, specially designed cradle fixtures may be required to support the tool in order to ease assembly. These same fixtures may ship with each tool for shipping and maintenance/assembly purposes on location. The MRRT may come equipped with both box and pin lift subs. For standard assembly, the MRRT may be placed standing upright with the box end down and with the thread protector installed. This may be accomplished by lifting the MRRT out of its cradle using the pin side lifting sub and setting the box end down into the accompanying fixture. The cup seal assembly components can then be assembled as described above.

Once manufactured, assembled, and installed, the MRRT may require maintenance. Achieving the goal of minimal pieces for the MRRT will keep maintenance efforts and costs to a minimum. The simple design should stand up to the harsh offshore environment and the neglect of users. However, the cup seal assembly is the one piece that may not withstand repeated abuse as it is responsible for maintaining a pressure differential. This item is thus a tangible part to be replaced once it begins to show wear or cuts in the rubber. Maintaining the body, retaining nut, and spacer sleeve may fall under a standard maintenance protocol with respect to threads, magnetic particle inspection (MPI), and general washing. Inspection of the remaining wall thickness will also be required to ensure that an appropriate amount of material remains between the entry and exit flow paths of the body.

A maintenance schedule may be implemented to preserve and protect the MRRT. Generally, the MRRT's design requires little maintenance. The maintenance will be accomplished through an approved procedure and will consist of recommendations for both pre-job and post-job as well as storage and shelf life. The body connections may require a UV (black light) non-destructive testing (NDT) before each job. The entire body may require periodic UV NDT for any signs of substantial erosion of the body. The body should be cleaned and coated with a rust preventing agent after each use to prevent excessive moisture exposure.

The cup seal assemblies are manufactured from durable rubber and hold pressure downhole. The cup seal assembly elements are in constant contact with the inner diameter (ID) of the riser when being run downhole as well as when pressure is applied; therefore the cup seal assemblies, including o-rings, are replaced once any wear or cuts are noticed in the cup seals. Each cup seal assembly may be able to complete multiple trips down the riser depending on the roughness of the riser and depth of travel of the tool.

All of the MRRT's components are expected to have a long shelf life when maintained properly. All components will require periodic checks for both wear and erosion. The MRRT may be shipped in a specially designed cradle fixture. The MRRT can be shipped fully assembled or in pieces if the operator chooses to assemble the MRRT on location. It is highly recommended that the MRRT be fully assembled before reaching location except for times when circumstances do not allow.

Figure 10:
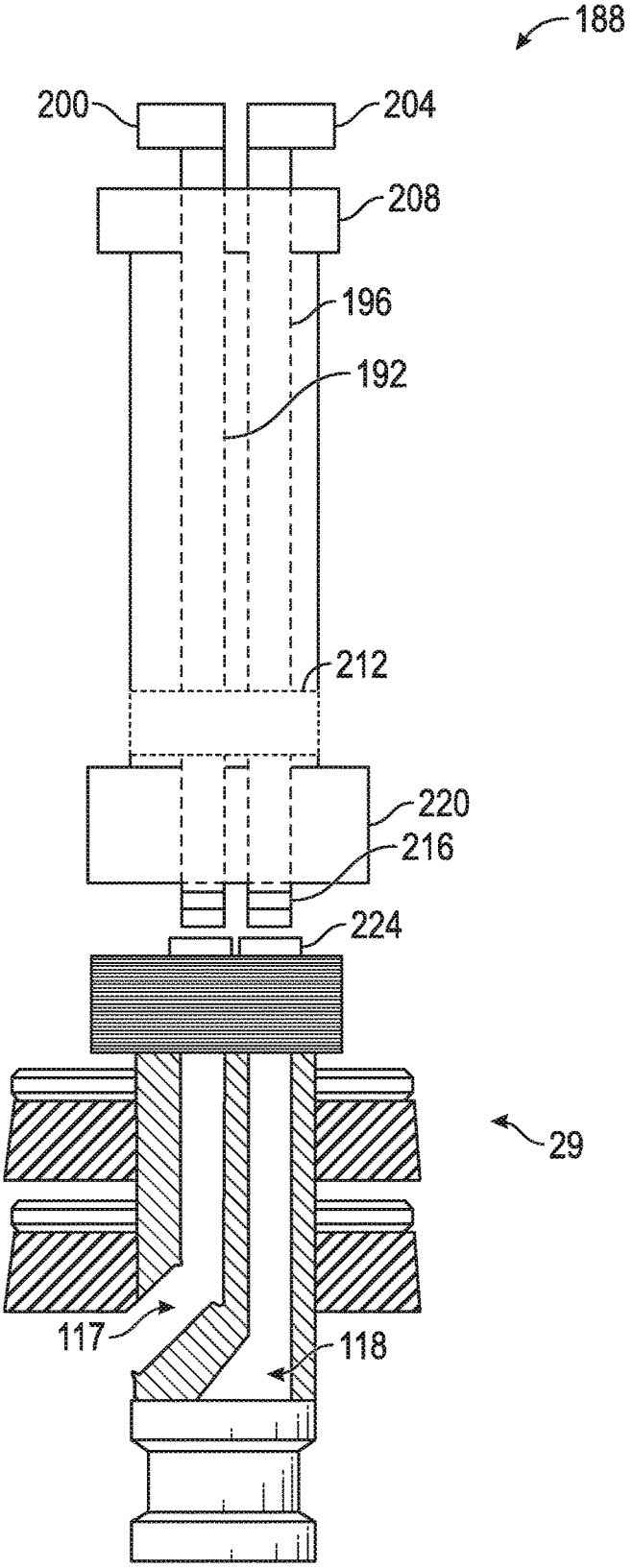
FIG. 10 is a cross-sectional view of the MRRT with a return adapter in one embodiment of the present invention.

Now referring to FIG. 10, an alternative embodiment of the MRRT 29 is provided where a return adapter 188 extends upward from the MRRT 29. The return adapter 188 has a first inner tube 192 and a second inner tube 196. The first inner tube 192 operably interconnects a surface pump 200 to the downward channel 117 of the MRRT 29, and the second inner tube 196 operably interconnects the upward channel 118 of the MRRT 29 to a surface return 204. In some embodiments, the second inner tube 196 has a diameter that is substantially similar to the diameter of the upward channel 118 and or the interior of the workstring below the MRRT 29. This allows the fluid traveling through the upward channel 118 to maintain a relatively higher velocity to the surface of the well.

The two inner tubes 192, 196 are mounted in the return adapter 188 at an elevator catch 208 at an uphole end of the return adapter 188 and at a block 212 at a downhole end of the return adapter 188. Seal stabs 216 may be positioned on the downhole side of the return adapter 188, and the seal stabs 216 may be selectively interconnected to the block 212. Next, a quick make up connection 220 may be utilized to selectively interconnect the seal stabs 216 into a polished bore receptacle (PBR) 224 positioned on the uphole side of the MRRT 29.

D. Bi-directional Chamber Trap

The Bi-directional Chamber Trap (BDCT) aspect of the present invention may be used in systems and methods for drilling and completion of wells. It will be appreciated by one skilled in the art that use of the BDCT will be beneficial in any environment where fluid entering or leaving the well needs to be filtered. One benefit of the BDCT is that it permits debris and trash upstream of the mud pump to be captured before entering the drill pipe via the top drive.

In a preferred embodiment of the present invention, BDCT 26 serves as a bi-directional filter that allows a single in-line tool to provide fluid filtration in either flow direction. The BDCT provides the additional benefit of being capable of running in parallel (as shown in FIG. 12B) or in series with additional BDCTs to provide redundancy or additional effectiveness. Redundancy allows for operations to continue if less than all units experience a failure. Additional effectiveness is achieved at least through the addition of additional chamber space to hold filtered debris or through the use of differing filter screen gauges to filter smaller debris. It will be appreciated that use of some embodiments of the BDCT will provide a last defense against debris or other undesirable particulate from being pumped into the well or being pumped out of the well and into the pumping system.

Figure 11:
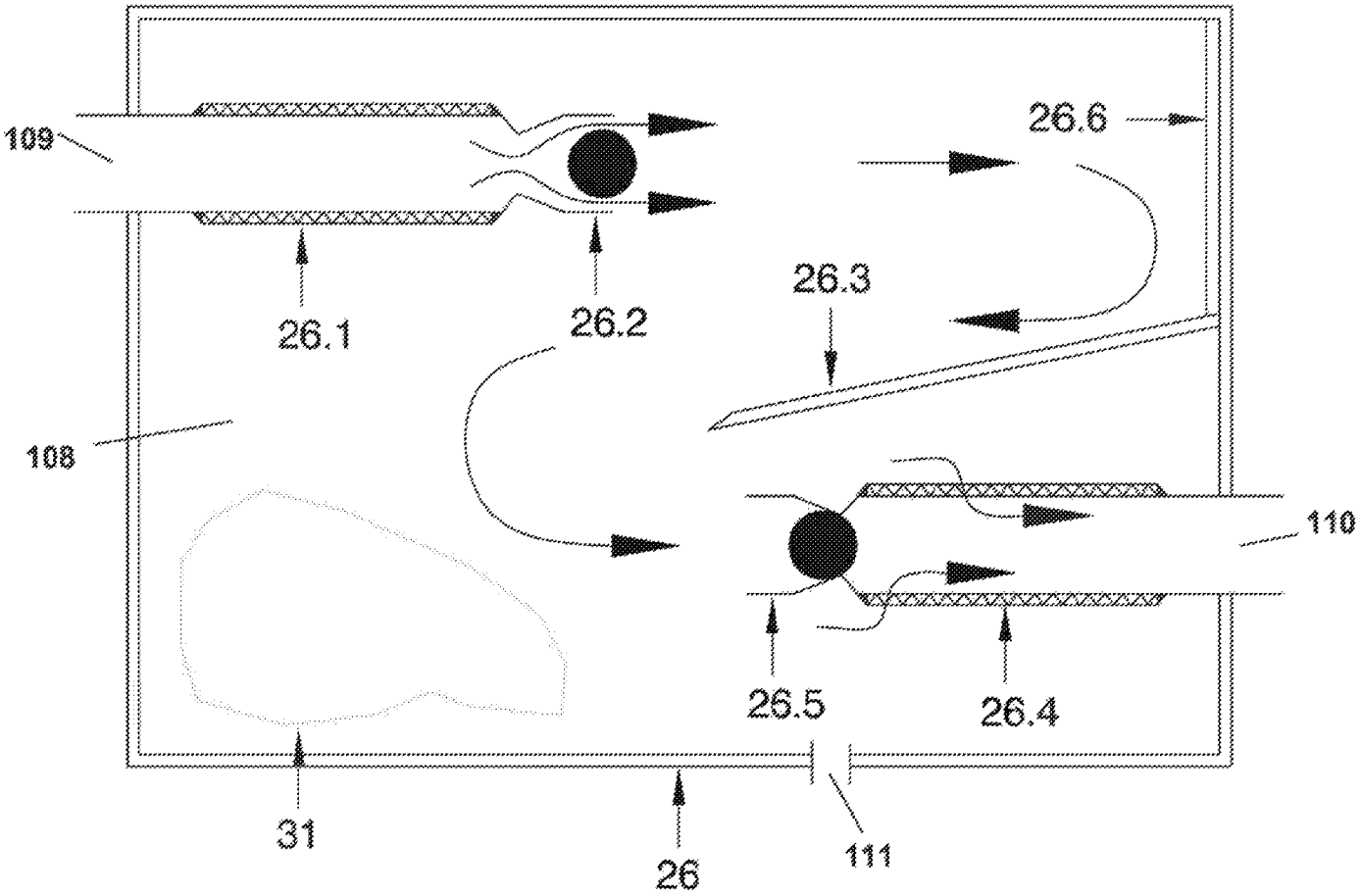
FIG. 11 is a detailed, cross-sectional view of the BDCT in one embodiment of the present invention.

Referring to FIG. 11, in a preferred embodiment of the BDCT, BDCT 26 is comprised of a horizontal cylindrical chamber 108 with three ports. In this embodiment, one port is located on each end of the cylindrical chamber. In a preferred embodiment, the ports are offset from one another both horizontally and vertically, with upstream port 109 being located closer to the top of BDCT 26 than downstream port 110. It will be appreciated that the placement of upstream port 109 closer to the top of chamber 108 creates a larger area in the bottom of chamber 108 to allow debris 31 to settle and collect when BDCT 26 is operated in the forward direction. BDCT 26 being placed in-line in a circulation system, it will be appreciated that the port into which fluid flows during normal operation of the circulation system is upstream port 109, whereas the port on the other side is downstream port 110. The third port is a clean-out port 111 and is located at the bottom of chamber 108, with clean-out valve 39 coupled to clean-out port 111 on the exterior of BDCT 26. On the interior of the chamber, coupled to upstream port 109 is upstream filter medium 26.1 and coupled to downstream port 110 is downstream filter medium 26.4. Both filter mediums can be the DeltaPore HP™, manufactured by Delta Screens, although other mediums well known in the art can be used. Coupled to the end of upstream filter medium 26.1 is upstream ball check valve 26.2. Coupled to the end of downstream filter medium 26.4 is downstream ball check valve 26.5. In a preferred embodiment, the ball check valves 26.2, 26.5 may be comprised of ball 93 of very hard and corrosion resistant material, valve body 94, and ball keeper pin 95. The inclusion of ball keeper pin 95 in ball check valves 26.2, 26.5 allows ball 93 to be changed if necessary, thus prolonging the life of the ball check valves 26.2, 26.5. In some embodiments, ball check valves 26.2, 26.5 may be a Pedcor series 13-3000 ball check valves, although other commercially available ball check valves may be used. Further included inside the chamber 108 is baffle 26.3, positioned in a manner that diverts the flow of fluid and debris 31 inside chamber 108 to allow gravitational force greater time to aid in the separation of debris 31 from fluid. Additionally, in a preferred embodiment of the present invention, BDCT 26 may include wear plate 26.6 in order to protect against excessive wear at the point where debris-laden fluid initially contacts the inside of chamber 108.

In one embodiment of the invention, the BDCT is placed into a circulation system of a rig surface system, such as that depicted in FIGS. 1A and 1B. The circulation system consists of suction pits 17, mud pump 14, standpipe 11, choke manifold 12 and BDCT 26, which together work to feed fluid to the well. In this embodiment, BDCT 26 is placed downstream of mud pumps 14 and upstream of stand pipe 11. The forward circulation path of the circulation system travels from mud pump 14 through BDCT 26 to standpipe 11.

In one embodiment of the invention, fluid potentially carrying debris and/or trash is pumped by mud pump 14 to BDCT 26. The pumped fluid enters BDCT 26 through upstream port 109. Any debris or trash in the fluid passes through upstream ball check valve 26.2 and enters chamber 108 of BDCT 26. Once the fluid and debris 31 or trash enters chamber 108, the flow path is diverted by baffle 26.3. The diversion of the flow path facilitates the separation of the debris 31 and trash from the fluid. As debris 31 separates from the fluid, it settles in the bottom of chamber 108. As fluid continues to flow along the flow path through BDCT 26 it arrives at downstream filter medium 26.4. Because downstream ball check valve 26.5 is closed while the circulation system pumps in the forward direction, debris 31 and trash become trapped in chamber 108. The fluid, removed of any debris 31, leaves BDCT 26 through downstream filter medium 26.4 and moves to standpipe 11 towards the well.

Figure 12A:
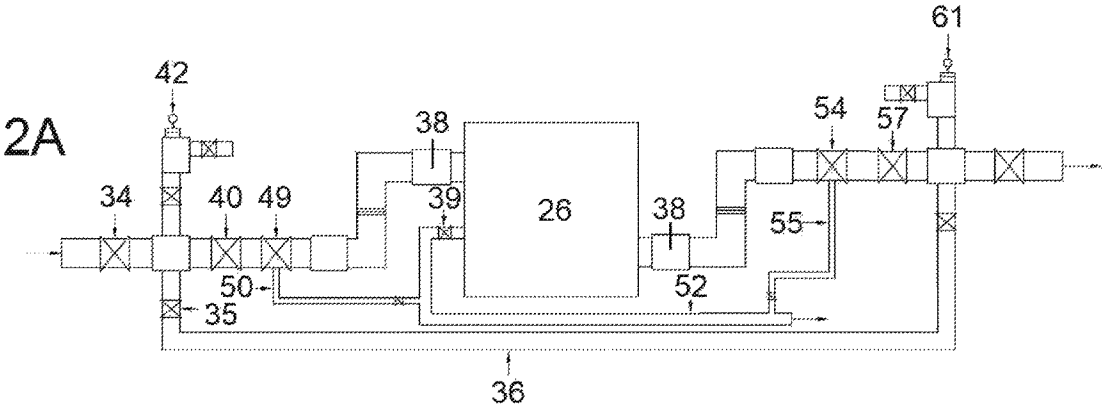
FIG. 12A is a schematic diagram of a single BDCT system in one embodiment of the present invention.
Figure 12B:
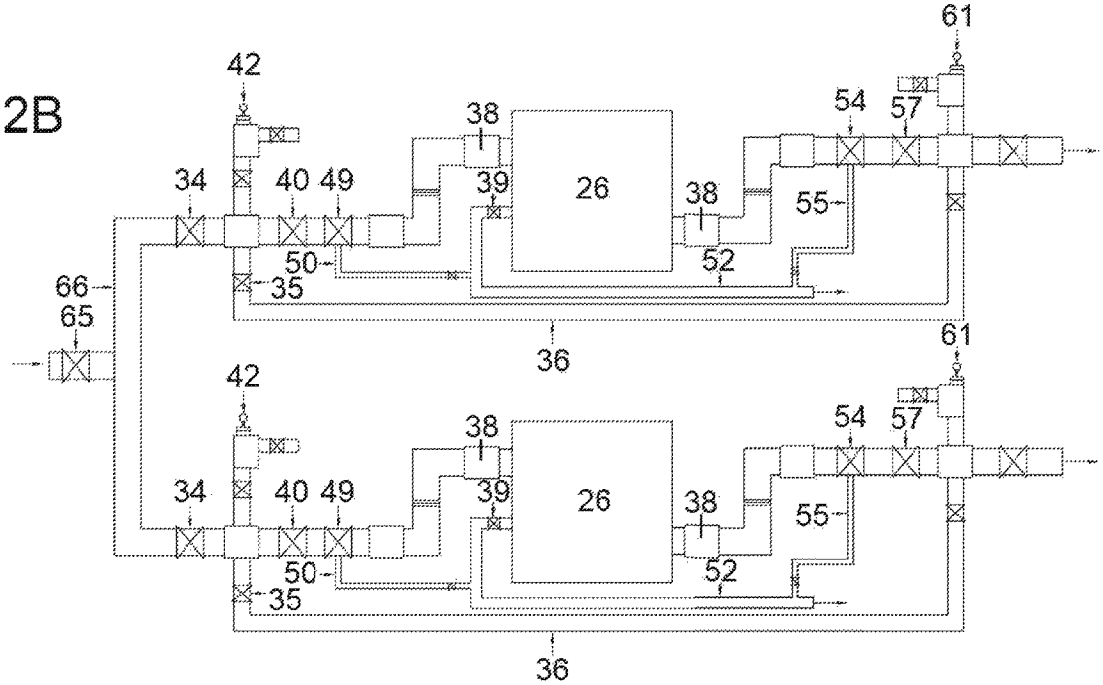
FIG. 12B is a schematic diagram of a parallel BDCT system in one embodiment of the present invention.

Referring to FIG. 12A, in some embodiments of the present invention, an alert system provides a means to alert a well operator that BDCT 26 has filled or contains significantly large debris 31 or trash. The alert system is comprised of upstream pressure gauge 42 and downstream pressure gauge 61, which are located upstream and downstream, respectively, of forward direction flow into BDCT 26. Pressure gauges 42 and 61 monitor the pressure differential across BDCT 26 and indicate a blockage when a pressure trend is observed. Typically, this trend will very sharp, but different embodiments will indicate blockage in different manners. In some embodiments, in-line pop-offs 49 and 54 activate when a predetermined pressure is registered, which direct flow to pop-off bleed lines 50 and 55, which in turn feed into clean out line 52. In single BDCT embodiments, a bypass valve system, consisting of at least bypass valve 35 and bypass pipe 36, redirects fluid past BDCT 26 so that operations are not interrupted when BDCT 26 is not operational for any reason. Activation of the bypass valve system or parallel manifold valve system may occur via manual operation or automated limits.

Referring to FIG. 12B, in another embodiment of the present invention, two or more BDCTs 26 are run in parallel. In this embodiment, the flow of pumped fluid travels through a main valve 65 into a parallel manifold 66 that is coupled to both BDCTs 26. Each branch of the parallel manifold 66 contains valves 34 capable of stopping flow to one of BDCTs 26. In parallel BDCT embodiments, the parallel manifold valve system can divert fluid to the parallel BDCT in the event a BDCT is not operational or the alert system described senses a blockage. It will be appreciated that such a system will provide added benefit to a single BDCT system because at least one BDCT will usually be in operation. It will further be appreciated that in either single or parallel BDCT embodiments, operators can continue to operate the well when a BDCT is plugged with large debris.

In another embodiment of the preferred invention, the flow path of the circulation system is reversed. When fluid is pumped through BDCT 26 in the reverse direction, upstream ball check valve 26.2 closes and downstream ball check valve 26.5 opens. This configuration allows debris to enter BDCT 26 through downstream port 110 and become trapped in chamber 108. Fluid leaves BDCT 26 through upstream filter media 26.1, while debris is trapped by closed upstream ball check valve 26.2.

In the event BDCT 26 becomes plugged or needs periodic cleaning, BDCT 26 may be flushed by closing downstream valve 57 and opening clean-out valve 39. Clean-out valve 39 may be plumbed to a cuttings box, trash pit, shale shaker, mud tank or other location where it is desired that the debris be placed.

In the event BDCT 26 must receive a filter medium 26.1, 26.4 inspection or replacement, flow may be directed in the same manner as in the event of a debris blockage. That is, a single BDCT embodiment may be bypassed and a parallel BDCT embodiment may allow flow to be diverted to the one or more other BDCTs. Once flow is diverted from BDCT 26, isolation of the unit can be accomplished by closing upstream valves 34 and 40 to create a double barrier. Quick Test Unions ("QTU") 38 are then broken to access upstream or downstream filtering mediums 26.1, 26.4 for replacement or inspection. Once replaced or inspected, each QTU 38 is capable of being retested at the connection without retesting the rig circulation system.

As noted above, there may be various combinations of the devices and methods described herein. In one exemplary system, a MRRT is utilized in conjunction with a WPDT. As such, one embodiment of the invention may comprise a drilling string having a reversing tool that changes the downhole flowpath between a tubing and an annular space, wherein the reversing tool is located at a first position in the borehole, a debris trap positioned in the tubing, wherein the debris trap is located at a second position in the borehole, wherein the second position is deeper in the borehole than the first position.

The foregoing description of the preferred embodiments of the invention is by way of example only, and other variations of the above-described embodiments and methods are provided by the present invention. The embodiments described herein have been presented for purposes of illustration and are not intended to be exhaustive or limiting. Many variations and modifications are possible in light of the foregoing teaching.

What is claimed is:

1. A device for trapping debris, comprising:

a lower assembly having a lower screen and a check valve, wherein the lower screen is a thru-tubing screen;

an upper assembly having an upper screen and a check valve, wherein the upper screen is a thru-tubing screen, and wherein the check valve of the upper assembly is a ball check valve having a ball with a first density that is buoyant when submerged in fluid having a second density, wherein the second density is larger than the first density;

an assembly bridge formed between the lower assembly and the upper assembly; and wherein the check valve of the lower assembly is a ball check valve that is closed when the fluid flows in a forward direction, allowing the fluid and debris smaller than a gauge of the thru-tubing screen of the lower assembly to leave the assembly bridge, and open when the fluid flows in a reverse direction, allowing the fluid and debris to enter the assembly bridge;

wherein the ball check valve of the upper assembly is open when the fluid flows in the forward direction, allowing the fluid and debris to enter the assembly bridge, and closed when the fluid flows in the reverse direction, allowing the fluid and debris smaller than a gauge of the thru-tubing screen of the upper assembly to leave the assembly bridge.

2. The device of claim 1, wherein the lower screen and the upper screen have a substantially similar gauge.

3. The device of claim 1, wherein the upper assembly is arranged along a first axis, and the lower assembly is arranged along a second axis.

4. The device of claim 3, wherein the first axis and the second axis are substantially parallel.

5. The device of claim 1, wherein the lower assembly, the upper assembly, and the assembly bridge are positioned in a deck crate having predetermined dimensions.

6. The device of claim 5, wherein the upper assembly is secured to the deck crate with first securing means, and the lower assembly is secured to the deck crate with second securing means.

7. The device of claim 1, wherein the assembly bridge comprises:

a first bridge sub having a first drain plug that is selectively removable from the first bridge sub to allow the removal of contents from the assembly bridge, and a second bridge sub having a second drain plug that is selectively removable from the second bridge sub to allow removal of contents from the assembly bridge.

8. The device of claim 7, wherein first bridge sub interconnects to the second bridge sub.

9. A device for trapping debris, comprising:

a lower assembly having a lower screen and a check valve, wherein the lower screen is a thru-tubing screen;

an upper assembly having an upper screen and a check valve, wherein the upper screen is a thru-tubing screen, and wherein the check valve of the upper assembly is a ball check valve having a ball with a first density that is buoyant when submerged in fluid having a second density, wherein the second density is larger than the first density;

an assembly bridge formed between the lower assembly and the upper assembly; and wherein the check valve of the lower assembly is a ball check valve that is closed when the fluid flows in a forward direction, allowing the fluid and debris smaller than a gauge of the thru-tubing screen of the lower assembly to leave the assembly bridge, and open when the fluid flows in a reverse direction, allowing the fluid and debris to enter the assembly bridge;

wherein the ball check valve of the upper assembly is open when the fluid flows in the forward direction, allowing the fluid and debris to enter the assembly bridge, and closed when the fluid flows in the reverse direction, allowing the fluid and debris smaller than a gauge of the thru-tubing screen of the upper assembly to leave the assembly bridge;

wherein the upper assembly is arranged along a first axis, and the lower assembly is arranged along a second axis.

10. The device of claim 9, wherein the first axis and the second axis are substantially parallel.

11. The device of claim 9, wherein the lower assembly, the upper assembly, and the assembly bridge are positioned in a deck crate having predetermined dimensions.

12. The device of claim 11, wherein the upper assembly is secured to the deck crate with first securing means, and the lower assembly is secured to the deck crate with second securing means.

13. The device of claim 9, wherein the assembly bridge comprises:

a first bridge sub having a first drain plug that is selectively removable from the first bridge sub to allow the removal of contents from the assembly bridge, and a second bridge sub having a second drain plug that is selectively removable from the second bridge sub to allow removal of contents from the assembly bridge.

14. The device of claim 13, wherein first bridge sub interconnects to the second bridge sub.

15. A device for trapping debris, comprising:

a lower assembly having a lower screen and a check valve, wherein the lower screen is a thru-tubing screen;

an upper assembly having an upper screen and a check valve, wherein the upper screen is a thru-tubing screen, and wherein the check valve of the upper assembly is a ball check valve having a ball with a first density that is buoyant when submerged in fluid having a second density, wherein the second density is larger than the first density;

an assembly bridge formed between the lower assembly and the upper assembly; and wherein the check valve of the lower assembly is a ball check valve that is closed when the fluid flows in a forward direction, allowing the fluid and debris smaller than a gauge of the thru-tubing screen of the lower assembly to leave the assembly bridge, and open when the fluid flows in a reverse direction, allowing the fluid and debris to enter the assembly bridge;

wherein the ball check valve of the upper assembly is open when the fluid flows in the forward direction, allowing the fluid and debris to enter the assembly bridge, and closed when the fluid flows in the reverse direction, allowing the fluid and debris smaller than a gauge of the thru-tubing screen of the upper assembly to leave the assembly bridge;

wherein the assembly bridge comprises (i) a first bridge sub having a first drain plug that is selectively removable from the first bridge sub to allow the removal of contents from the assembly bridge, and (ii) a second bridge sub having a second drain plug that is selectively removable from the second bridge sub to allow removal of contents from the assembly bridge.

16. The device of claim 15, wherein first bridge sub interconnects to the second bridge sub.

17. The device of claim 15, wherein the upper assembly is arranged along a first axis, and the lower assembly is arranged along a second axis.

18. The device of claim 17, wherein the first axis and the second axis are substantially parallel.

19. The device of claim 15, wherein the lower assembly, the upper assembly, and the assembly bridge are positioned in a deck crate having predetermined dimensions.

20. The device of claim 19, wherein the upper assembly is secured to the deck crate with first securing means, and the lower assembly is secured to the deck crate with second securing means.

* * * * *